US009272819B1

(12) United States Patent
Zabaleta et al.

(10) Patent No.: US 9,272,819 B1
(45) Date of Patent: Mar. 1, 2016

(54) RESEALABLE CONTAINER LID INCLUDING METHODS OF MANUFACTURE AND USE

(71) Applicants: Daniel A. Zabaleta, Cooper City, FL (US); Sam D. Hackett, Fort Lauderdale, FL (US)

(72) Inventors: Daniel A. Zabaleta, Cooper City, FL (US); Sam D. Hackett, Fort Lauderdale, FL (US)

( * ) Notice: Subject to any disclaimer, the term of this patent is extended or adjusted under 35 U.S.C. 154(b) by 0 days.

(21) Appl. No.: 14/665,102

(22) Filed: Mar. 23, 2015

Related U.S. Application Data

(60) Division of application No. 13/787,012, filed on Mar. 6, 2013, now Pat. No. 8,985,371, which is a continuation-in-part of application No. 13/572,404, filed on Aug. 10, 2012, now Pat. No. 8,844,761.

(51) Int. Cl.

| | |
|---|---|
| ***B65D 17/34*** | (2006.01) |
| ***B65D 41/04*** | (2006.01) |
| ***B65D 51/00*** | (2006.01) |
| ***B65D 51/16*** | (2006.01) |
| ***B65D 51/22*** | (2006.01) |

(52) U.S. Cl.
CPC ..... *B65D 41/04* (2013.01); *B65D 51/007* (2013.01); *B65D 51/1677* (2013.01); *B65D 51/222* (2013.01); *B65D 2517/0097* (2013.01)

(58) Field of Classification Search
CPC .. B65D 2205/00; B65D 47/36; B65D 51/007; B65D 51/1672; B65D 51/1677; B65D 51/22; B65D 2517/0097; B65D 2517/0091; B65D 2543/00898; B65D 51/221; B65D 51/222
USPC ..... 220/906, 254.8, 258.1, 258.3–258.5, 220/274, 275, 277, 278, 281, 284, 212.5, 220/293, 298; 215/295–299, 301, 305; 222/81, 83
See application file for complete search history.

(56) References Cited

U.S. PATENT DOCUMENTS

| | | | |
|---|---|---|---|
| 2,004,964 | A | 6/1935 | Westgate |
| 2,112,231 | A | 3/1938 | Speidel et al. |
| 2,303,205 | A | 11/1942 | Frankenberg |
| 2,384,810 | A | 9/1945 | Calleson |
| 2,409,788 | A | 10/1946 | Osborne |
| 2,426,550 | A | 8/1947 | Coyle |
| 3,029,507 | A | 4/1962 | Gaggini |

(Continued)

FOREIGN PATENT DOCUMENTS

| | | | |
|---|---|---|---|
| CA | 476789 | A | 9/1951 |
| EP | 2212215 | B1 | 2/2012 |

(Continued)

*Primary Examiner* — Fenn Mathew
*Assistant Examiner* — James N Smalley
(74) *Attorney, Agent, or Firm* — Allen D. Hertz, P.A.; Allen D. Hertz

(57) ABSTRACT

A resealable container lid assembly including a cap rotationally assembled to a lid. The cap rotates between storage, opening, removal and resealing positions. Various configurations of cams and ramps are used to generate and apply an opening force to a score line. An elastomeric sealing element is disposed between the cap and the socket so that when the cap is in the fully seated or sealed position, an substantially or completely airtight seal is created to prevent the contents of the container from leaking out. Further enhancements are disclosed that include a score line structure in the socket bottom wall that facilitates a predictable and repeatable opening of the container along the score line. A grip is provided that includes a gap or space into which a coin or other implement can be inserted to allow the consumer a better grip to provide adequate opening force.

20 Claims, 35 Drawing Sheets

(56) References Cited

U.S. PATENT DOCUMENTS 3,176,872 A 4/1965 Zundel
3,191,564 A 6/1965 Fraze
3,225,957 A 12/1965 Huth
3,255,917 A 6/1966 Fraze
3,303,960 A 2/1967 Fraze
3,349,949 A 10/1967 Brown
3,361,291 A 1/1968 Fraze
3,439,640 A 4/1969 Fraze
3,439,833 A 4/1969 Fraze
3,446,389 A 5/1969 Brown
3,480,175 A 11/1969 Khoury
3,638,597 A 2/1972 Brown
3,643,833 A 2/1972 Fraze et al.
3,726,432 A 4/1973 Gentile
3,752,353 A 8/1973 Slade
3,795,342 A 3/1974 Ashton
3,844,443 A 10/1974 Cudzik
3,856,184 A 12/1974 Luviano
3,871,314 A 3/1975 Stargell
3,877,604 A * 4/1975 Brown ..... 220/267
3,880,318 A 4/1975 Fraze
3,910,453 A 10/1975 Kneusel et al.
3,924,777 A 12/1975 Peyser
3,938,693 A * 2/1976 Patel et al. ..... 222/81
3,967,752 A 7/1976 Cudzik
4,007,848 A 2/1977 Snyder
4,042,144 A 8/1977 Henning
4,065,025 A 12/1977 Potts
4,078,695 A 3/1978 Potts
4,116,360 A 9/1978 Stargell
4,116,361 A 9/1978 Stargell
4,122,971 A 10/1978 Potts
4,172,532 A * 10/1979 Palsson ..... 215/215
4,182,460 A 1/1980 Holk et al.
4,262,815 A 4/1981 Klein
4,286,728 A 9/1981 Fraze et al.
4,386,713 A 6/1983 Baumeyer
4,399,925 A 8/1983 Fundom
D273,846 S 5/1984 Fraze
4,476,987 A 10/1984 Nolan
4,567,746 A 2/1986 Fraze et al.
4,574,975 A 3/1986 Cudzik et al.
4,685,849 A 8/1987 LaBarge et al.
4,705,186 A 11/1987 Barrash
4,711,611 A 12/1987 Fraze et al.
4,723,687 A * 2/1988 Kutterer ..... 222/83
4,793,510 A 12/1988 Arfert et al.
RE32,927 E 5/1989 Taylor
4,865,215 A * 9/1989 Wells ..... 220/269
4,872,597 A 10/1989 Hanafusa
5,052,576 A 10/1991 Budenbender
5,248,053 A 9/1993 Lundgren
5,292,025 A 3/1994 Dubreul
5,293,765 A 3/1994 Nussbaum
5,356,030 A 10/1994 Budenbender
5,421,480 A 6/1995 Cudzik
5,443,175 A * 8/1995 Kelly et al. ..... 220/298
5,511,920 A 4/1996 Artrip
5,622,208 A 4/1997 Vinson
D387,987 S 12/1997 Neiner
5,692,633 A 12/1997 Gordon
5,711,447 A 1/1998 Plester
5,713,235 A 2/1998 Diekhoff
5,718,352 A 2/1998 Diekhoff
5,778,723 A 7/1998 Diekhoff
5,779,086 A 7/1998 Barrash
5,785,198 A 7/1998 Credle
5,799,775 A * 9/1998 Spring ..... 206/222
5,816,428 A 10/1998 Plester
5,822,843 A 10/1998 Diekhoff
5,947,318 A * 9/1999 Palm ..... 220/278
5,975,322 A 11/1999 Reid
6,010,026 A 1/2000 Jordan et al.
6,010,028 A 1/2000 Jordan et al.
6,082,944 A 7/2000 Bachmann
6,105,807 A 8/2000 McCrossen
6,206,222 B1 * 3/2001 Cudzik ..... 220/258.3
6,216,904 B1 4/2001 Cagan
6,234,338 B1 5/2001 Searle
6,330,954 B1 12/2001 Turner et al.
6,332,551 B1 12/2001 Copeland
6,450,358 B1 9/2002 Berro
6,460,723 B2 10/2002 Nguyen et al.
6,575,325 B2 6/2003 Dickie et al.
6,626,314 B1 9/2003 McHenry et al.
6,651,833 B2 11/2003 Sciarini
6,739,471 B2 5/2004 Goetz et al.
6,779,677 B2 8/2004 Chupak
6,877,941 B2 4/2005 Brifcani
6,889,862 B2 5/2005 Vaughan
6,910,598 B2 6/2005 Gotz et al.
7,014,060 B2 3/2006 Richardson
D559,680 S 1/2008 Jacober et al.
7,500,577 B2 3/2009 Wichelhaus
7,743,635 B2 6/2010 Jentzsch
7,823,740 B2 11/2010 Perra
7,841,222 B2 11/2010 Cook et al.
7,891,517 B2 2/2011 Simmons
7,918,359 B2 4/2011 Paris et al.
7,918,363 B2 4/2011 Morabito et al.
8,215,513 B1 7/2012 Grissom
8,328,041 B2 12/2012 Brifcani
8,336,726 B2 12/2012 Ramsey et al.
8,336,728 B2 12/2012 Forrest et al.
8,534,490 B2 9/2013 Chapin
8,556,106 B1 * 10/2013 Bayat et al. ..... 220/294
8,720,717 B2 5/2014 Kaanta et al.
8,939,311 B2 1/2015 Christopoulos et al.
2001/0040167 A1 11/2001 Flecheux et al.
2002/0030053 A1 3/2002 Copeland
2003/0116521 A1 6/2003 Chupak
2003/0213709 A1 * 11/2003 Gibler et al. ..... 206/219
2003/0213803 A1 11/2003 Chasteen
2004/0159662 A1 8/2004 Johnson
2004/0256386 A1 12/2004 LaFortune
2005/0029264 A1 2/2005 Werth
2005/0115969 A1 6/2005 Mizuma
2005/0127077 A1 6/2005 Chupak
2005/0150889 A1 7/2005 Perra
2005/0279746 A1 12/2005 Hsu
2007/0045318 A1 3/2007 Gibson et al.
2008/0053997 A1 3/2008 Perra
2008/0099480 A1 5/2008 Chang
2008/0110922 A1 5/2008 Sines
2008/0237235 A1 10/2008 Morabito et al.
2009/0026201 A1 1/2009 Hall et al.
2009/0045158 A1 2/2009 Suriol
2009/0200306 A1 8/2009 Breunig
2009/0261101 A1 10/2009 Forrest et al.
2010/0126992 A1 5/2010 Phillips
2010/0133275 A1 6/2010 Phillips
2010/0294768 A1 11/2010 Ramsey et al.
2010/0320207 A1 * 12/2010 Sjogren et al. ..... 220/270
2011/0036839 A1 2/2011 Gardner
2011/0036840 A1 2/2011 Zakai
2011/0062106 A1 3/2011 Akveld
2011/0100946 A1 5/2011 Perra
2011/0226636 A1 9/2011 Petti
2011/0232423 A1 9/2011 Raymond
2012/0012586 A1 1/2012 Rinderer
2012/0037631 A1 2/2012 Weist
2012/0228294 A1 9/2012 Grissom
2012/0273490 A1 11/2012 Jensen
2013/0082055 A1 4/2013 Ramsey et al.
2013/0200034 A1 8/2013 Kaanta et al.
2014/0238994 A1 8/2014 Christopoulos et al.

FOREIGN PATENT DOCUMENTS

EP 2555988 A1 6/2014
WO WO 2011025327 A2 3/2011
WO WO 2011124552 A1 10/2011

* cited by examiner

RESEALABLE CONTAINER LID INCLUDING METHODS OF MANUFACTURE AND USE

CROSS-REFERENCE TO RELATED APPLICATIONS

This Non-Provisional Patent Application is:

a Divisional Patent Application claiming the benefit of co-pending United States Non-Provisional Utility patent application Ser. No. 13/787,012, filed on 6 Mar. 2013 (scheduled to issue on 24 Mar. 2015), which is a Continuation-In-Part claiming the benefit of co-pending United States Non-Provisional Utility patent application Ser. No. 13/572,404, filed on 10 Aug. 2012 (Issued as U.S. Pat. No. 8,844,761 on 30 Sep. 2014), and all of which are incorporated by reference herein.

TECHNICAL FIELD

The present invention relates to a resealable lid and cap combination for a container, including the structure, method of manufacturing, and method of use thereof. In general, the resealable lid is assembled to a container such as an aluminum beverage can. The cap is assembled to the lid and rotated by the consumer to open and reseal the can. The rotational movement of the cap is converted into linear motion by one or more cam mechanisms to effect an opening action, fracturing a score line and bending a tear panel inward into the can. Once the can is opened, the cap can be removed for consumption of content stored therein and replaced to reseal the opened lid.

BACKGROUND OF THE PRESENT INVENTION

The beverage and can industries have long sought to create a can that is both economical to produce and convenient for use by consumers. In the past, beverage cans were provided with a "pull tab" which the consumer would grab by a ring, and pull until the tab was removed from the can. This created a problem in that the tab became disposable waste for which the consumer was responsible to ensure proper disposal. Often the consumer failed to properly dispose of the tab, thereby creating not only litter, but also a safety issue, in that the tabs could be swallowed by small children. Moreover, the edges of the pull tab were sharp enough that they could, if mishandled, cut the fingers or hands of the consumer or anyone else who handled a loose pull tab. As a result of these problems, the industry moved in the direction of a tab that stayed on the can after opening, thereby preventing both litter and any sharp edges from coming into contact with consumers.

The present state of the art is to have a "stay on" tab that is attached to the can lid by a rivet formed in the can lid next to the opening. The opening is formed by a score line, or frangible "kiss cut" which breaks when the tab is pulled up by the consumer. The score line, when broken, produces a hinged flap that stays connected to the can lid, but inside the can.

Beverage cans with stay on tabs suffer from at least the following deficiencies. First, they are not resealable, so that once the consumer opens the beverage, the contents are subject to loss of carbonation, and the influx of foreign material due to the contents being open to the surrounding environment. Secondly, in order to form the rivet which is used to secure the stay on tab to the beverage lid, the lid needs to be made of a different material, typically an aluminum alloy that is stronger than the aluminum alloy used to make the sides and bottom of the can. Further, the tab itself is typically made of a different alloy than the sides and lid, reflecting the need for a still stronger, typically heavier material As a result, recycling of the aluminum beverage can is problematic because the different materials need to be separated. The use of three different materials also tends to add weight, and expense, to the finished container.

A need exists for improved beverage containers that are resealable, cost effective to produce, and "green" in terms of avoiding waste and facilitating the recycling of aluminum cans. Concurrently, a need exists for improved methods for manufacturing beverage containers that result in faster production time, lower production costs, and improved products.

BRIEF DESCRIPTION OF THE PRESENT INVENTION

A container has a sidewall and integrally formed bottom. The container is preferably a beverage container, but could be adapted to any suitable container. A top lid includes a socket integrally formed therein; the socket including a substantially cylindrical sidewall and a bottom wall. A score line formed in the bottom wall defines a tear panel which forms an opening into the can when the score line is fractured and the tear panel is bent inward or removed. A cap is fitted in the socket and has a sidewall which is formed with cam surfaces. The cam surfaces, formed as grooves or slots, cooperate with bosses or detents formed in the cylindrical sidewall of the socket. The design of the cam surfaces and associated bosses translate the rotational motion of the cap into linear motion. wherein the linear motion fractures the score line and opens the tear panel. As the cap moves downwardly, a protrusion formed on the lower surface of the cap impinges on the periphery of the score line, fracturing the score line and subsequently pushes the tear panel into the can.

Once opened, the cap can be re-fitted into the socket, so that the cam surfaces engage the detents, and rotated to achieve a sealing position, whereby the contents of the can are protected from the ambient atmosphere. This will result in the prevention of spillage, the loss of carbonation, and the prevention of foreign objects from entering the can. The user can opt to discard the cap and/or container once the entire contents of the can are consumed.

Preferably, the container is a beverage container, commonly referred to as a "can," but the same principals described above could be used for other types of beverage containers, including bottles made of various materials, including plastic, paper, metal (such as aluminum), cartons, cups, glasses, etc. In one particularly preferred embodiment, the container can be an aluminum can manufactured of an Aluminum alloy material, and lid would be manufactured of the same Aluminum alloy material as the container. The cap is preferably made of plastic material of sufficient hardness that the cam surfaces do not deform during opening and closing operations.

The cap may be included with the container or offered as a separate implement, being sold separately from the beverage container, and re-useable after washing. Also, caps with different features may be provided, such as a cap that has a child's sip cup top, so that the beverage can be converted into a child's sip cup. Other implements can be envisioned, including a cap that has a baby bottle "nipple" formation to convert the beverage can into a baby bottle. In such an embodiment, the contents of the container could be infant formula. Each implement would be adapted to be removably attached to the resealable container lid.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

DETAILED DESCRIPTION OF THE PRESENT INVENTION

Figure 1:
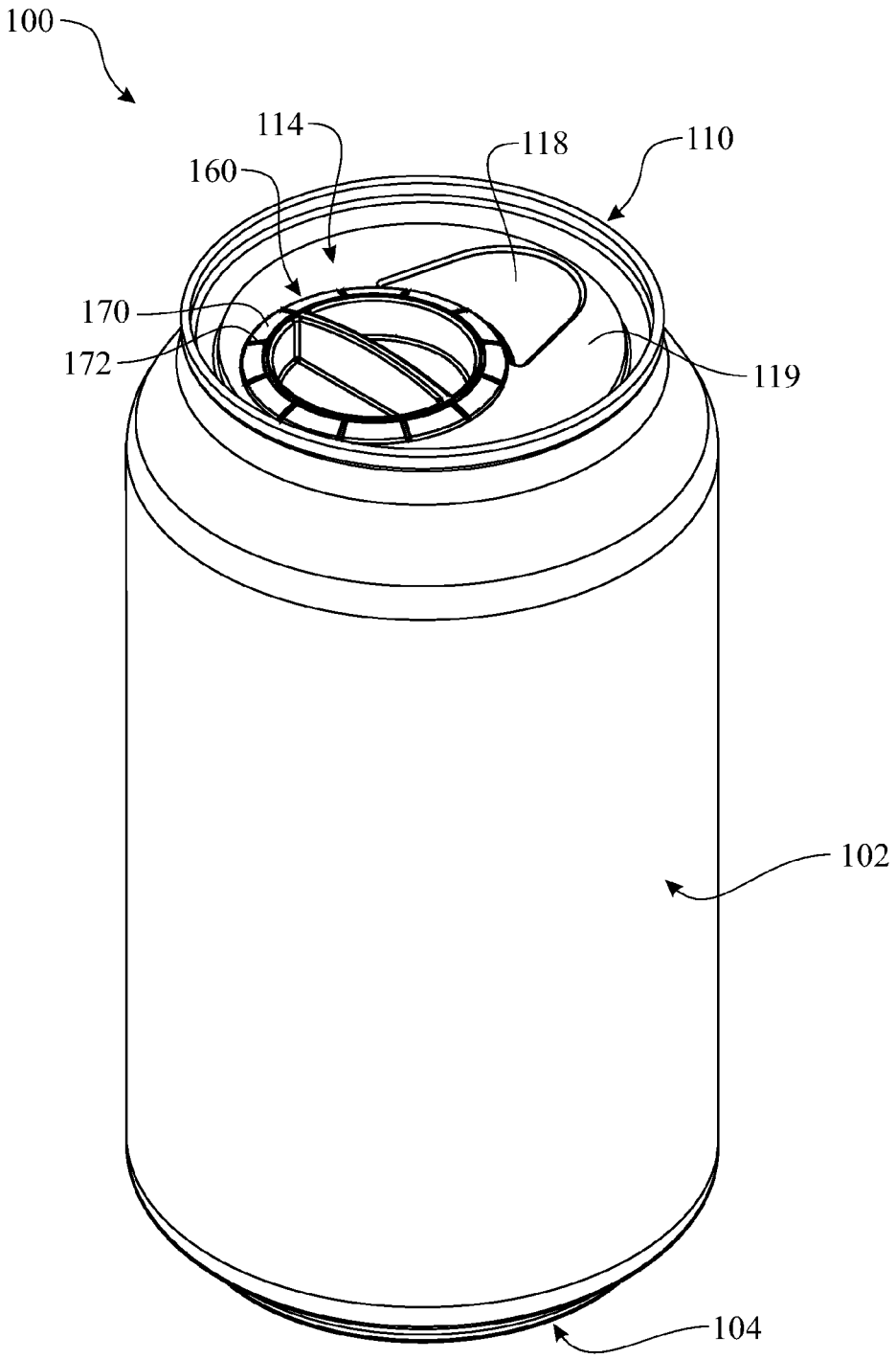
FIG. 1 presents a side isometric view introducing an exemplary container in accordance with the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

A container 100, exemplified as a beverage container in FIGS. 1 through 12, includes a container cylindrical sidewall 202, a container closed container closed bottom wall 204, integrally formed with the container cylindrical sidewall 102 and a resealable container lid 110 connected to the container cylindrical sidewall 102 at the end opposite the container closed container closed bottom wall 204. In the illustrated embodiment, the container 100 is a beverage container commonly referred to as a can, wherein the container closed container closed bottom wall 204 and the container cylindrical sidewall 102 are formed from a single piece of aluminum material, using otherwise known processes. The aluminum material is a lightweight aluminum alloy commonly used in the beverage can industry. The resealable container lid 110 is preferably made of the same lightweight aluminum alloy material, and is joined at the upper end of the sidewall through likewise known processes. The resealable container lid 110 includes a cap receiving socket 130 which extends downwardly into the container 100 from a resealable container lid upper surface 114. The cap receiving socket 130 is formed near a peripheral edge or lip of the resealable container lid 110 as is customary in the art, to allow drinking from the container 100. A resealable container cap 160 fits into the cap receiving socket 130 and engages same in a manner described in more detail below. The container cylindrical sidewall 202 of the container 100 is preferably tapered at both the upper and lower ends to provide greater structural integrity, particularly for use with pressurized contents, such as when used for carbonated beverages.

The resealable container lid 110 has an outer perimeter that is connected to the upper open end of the container cylindrical sidewall 102 of the beverage container, using known processes, to form an enclosure which contains a beverage. Beverages contained therein are not limited, but include carbonated or non-carbonated beverages, and could also include foodstuffs, and non-edible products. The cap receiving socket 130 is integrally formed in the resealable container lid upper surface 114 of the resealable container lid 110 and includes a cap receiving socket cylindrical sidewall 132, which extends downwardly into the container 100, and a cap receiving socket bottom wall 134, A cap receiving socket bottom panel circular score line 136 is formed in the cap receiving socket bottom wall 134 in order to create a cap receiving socket bottom panel tear panel 138 (see FIGS. 13B, 13C and 13D) which is pushed into the can when the can is opened. In the opened position, the cap receiving socket bottom panel tear panel 138 remains connected to the cap receiving socket bottom wall 134 due to the fact that the cap receiving socket bottom panel circular score line 136 does not make a complete circle or loop; a tear panel hinge 139 is created where the cap receiving socket bottom wall 134 is not scored (see FIG. 5).

Figure 9:
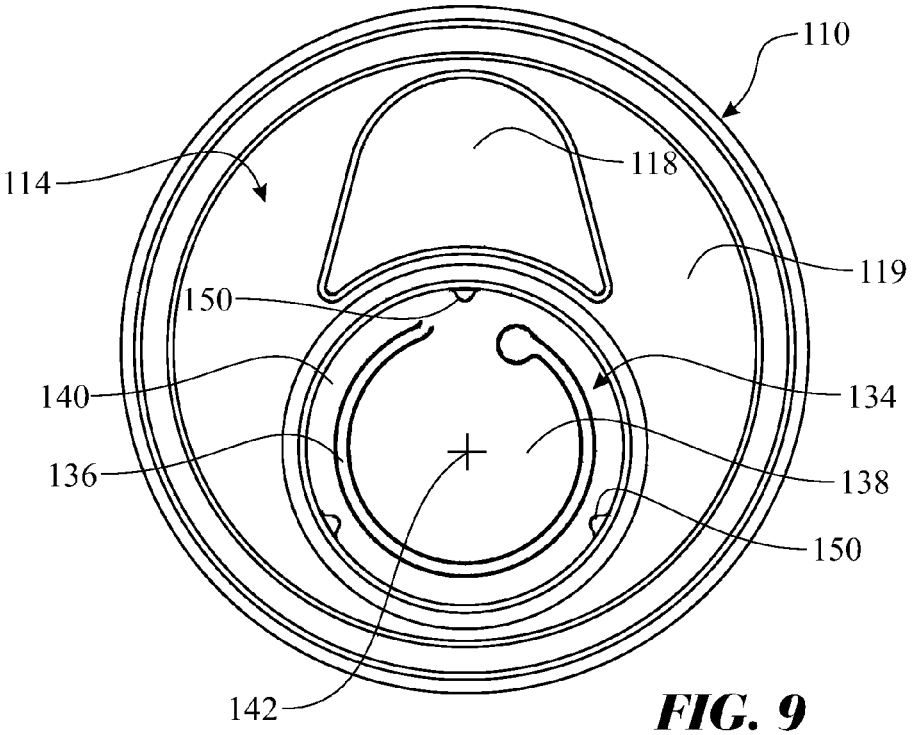
FIG. 9 presents a top view of the exemplary container originally introduced in FIG. 1 FIG., wherein the illustration excludes the cap to introduce projections inside the socket for engaging with cam surfaces of the cap.

As seen in figures, the resealable container cap 160 is sized to fit substantially within the cap receiving socket 130, and includes a flat annular cap bottom sealing surface 167 which is disposed between the cam shaped cap bottom surface 166 and the cap's resealable container cap cylindrical sidewall 162. In FIG. 9, the cap receiving socket bottom wall 134 of the cap receiving socket 130 may include a cap receiving socket bottom panel flat annular surface 140 which is disposed between the cap receiving socket cylindrical sidewall 132 and the cap receiving socket bottom panel circular score line 136. When assembled and in the "resealed" position shown in FIG. 13D, the flat annular cap bottom sealing surface 167 of the resealable container cap 160 comes into contact with the cap receiving socket bottom panel flat annular surface 140 of the bottom of the cap receiving socket 130 to effectively reseal the container 100.

The resealable container lid 110 has a shallow, resealable container lid upper surface reinforcement formation 118 which serves two purposes. First, the resealable container lid upper surface reinforcement formation 118 acts as a stiffening structure to provide greater strength to the resealable container lid 110. This is particularly advantageous if the resealable container lid 110 is to be made of the same aluminum alloy as the container cylindrical sidewall 102 and container closed container closed bottom wall 204 of the container 100. Secondarily, the resealable container lid upper surface reinforcement formation 118 adds a familiar look to consumers who are accustomed to the prior art beverage containers employing a pull tab that is operated first in an opening direction, and then secondly, in a seated direction, where the hinged pull tab is positioned after opening.

Figure 2:
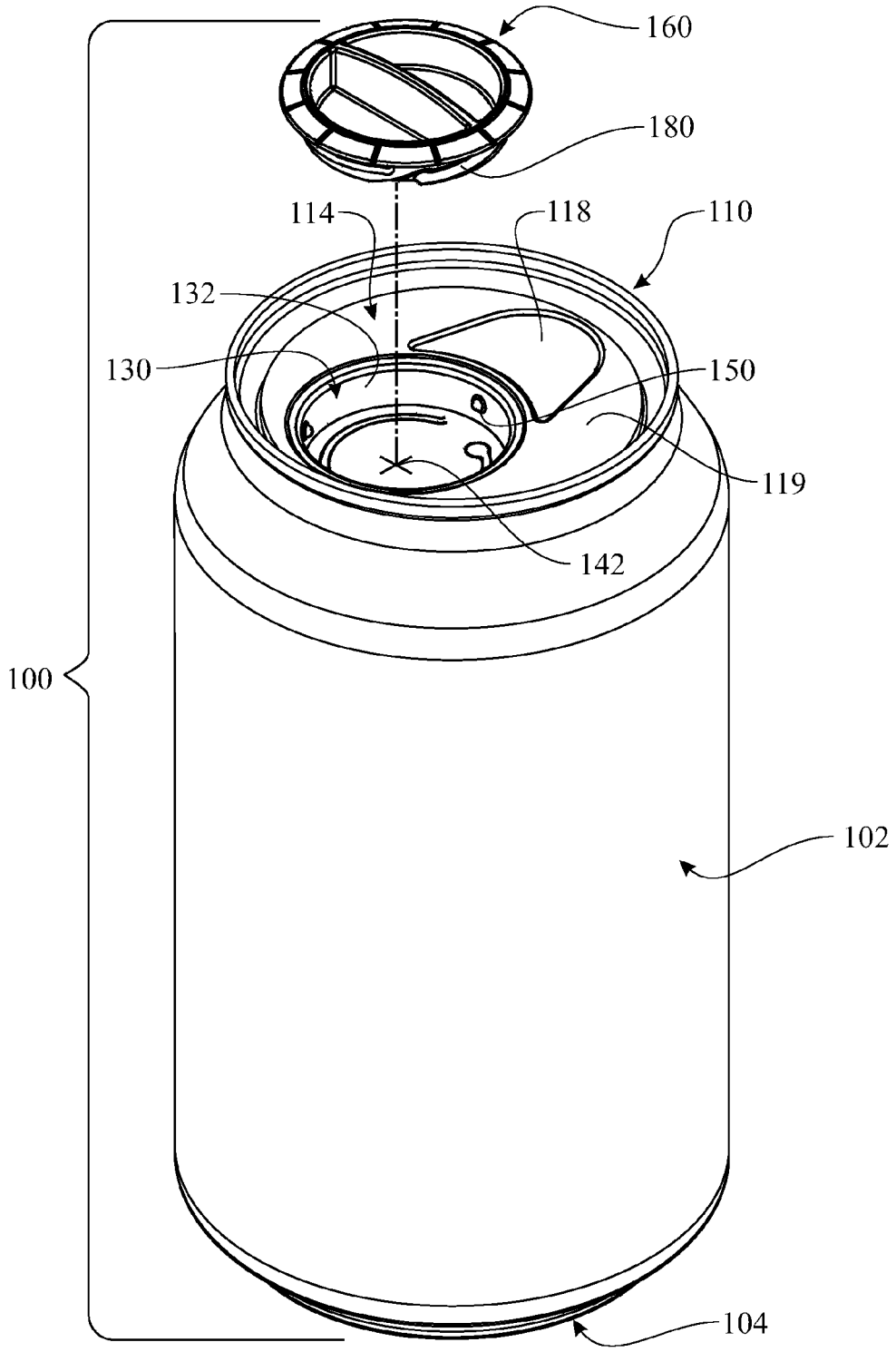
FIG. 2 presents a side isometric exploded assembly view of the container introduced in FIG. 1, wherein the illustration reveals features of a cap and a socket of the exemplary container.
Figure 3:
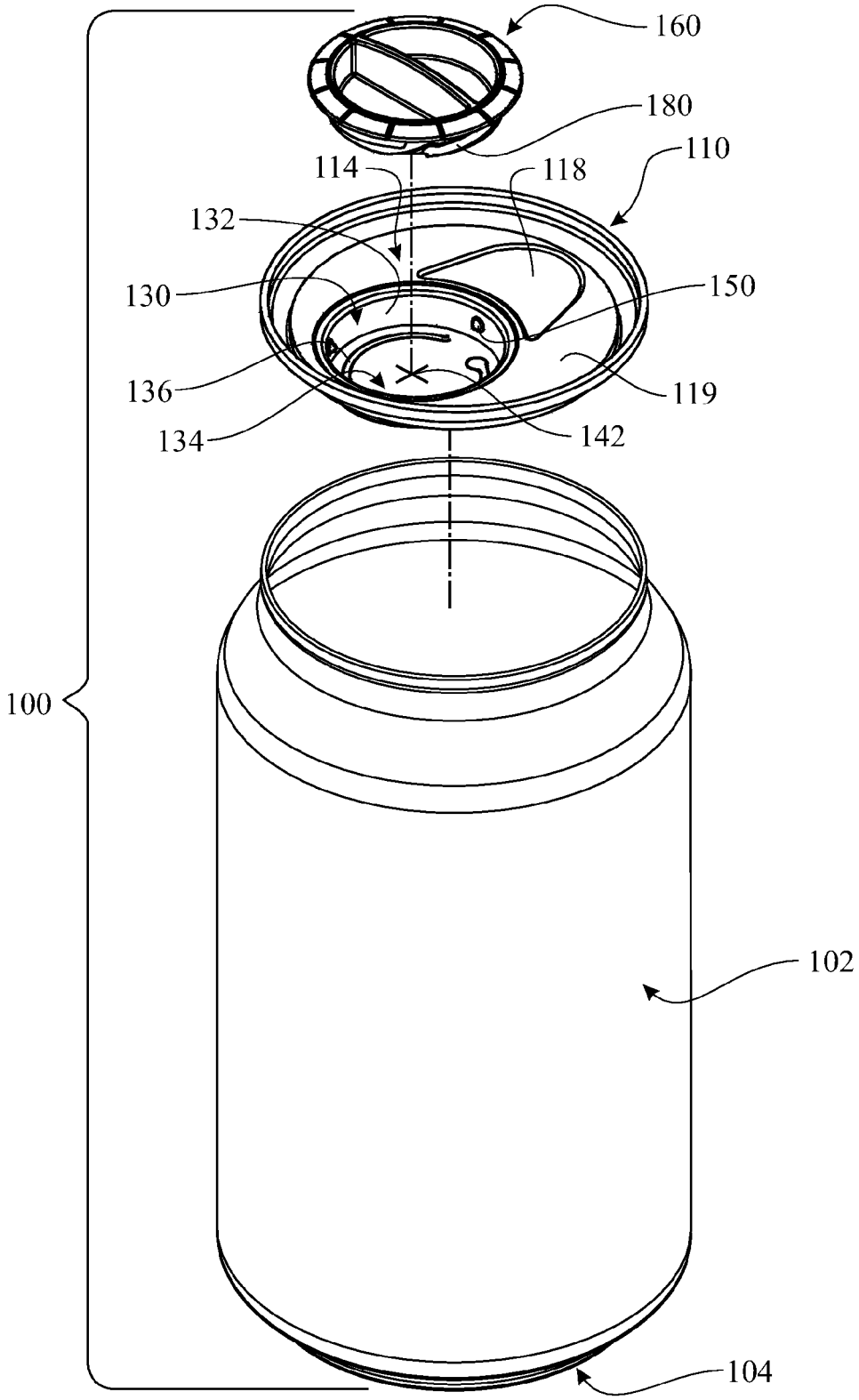
FIG. 3 presents a side isometric exploded assembly view of the container introduced in FIG. 1, wherein the illustration additionally separates the lid and the exemplary container body.
Figure 4:
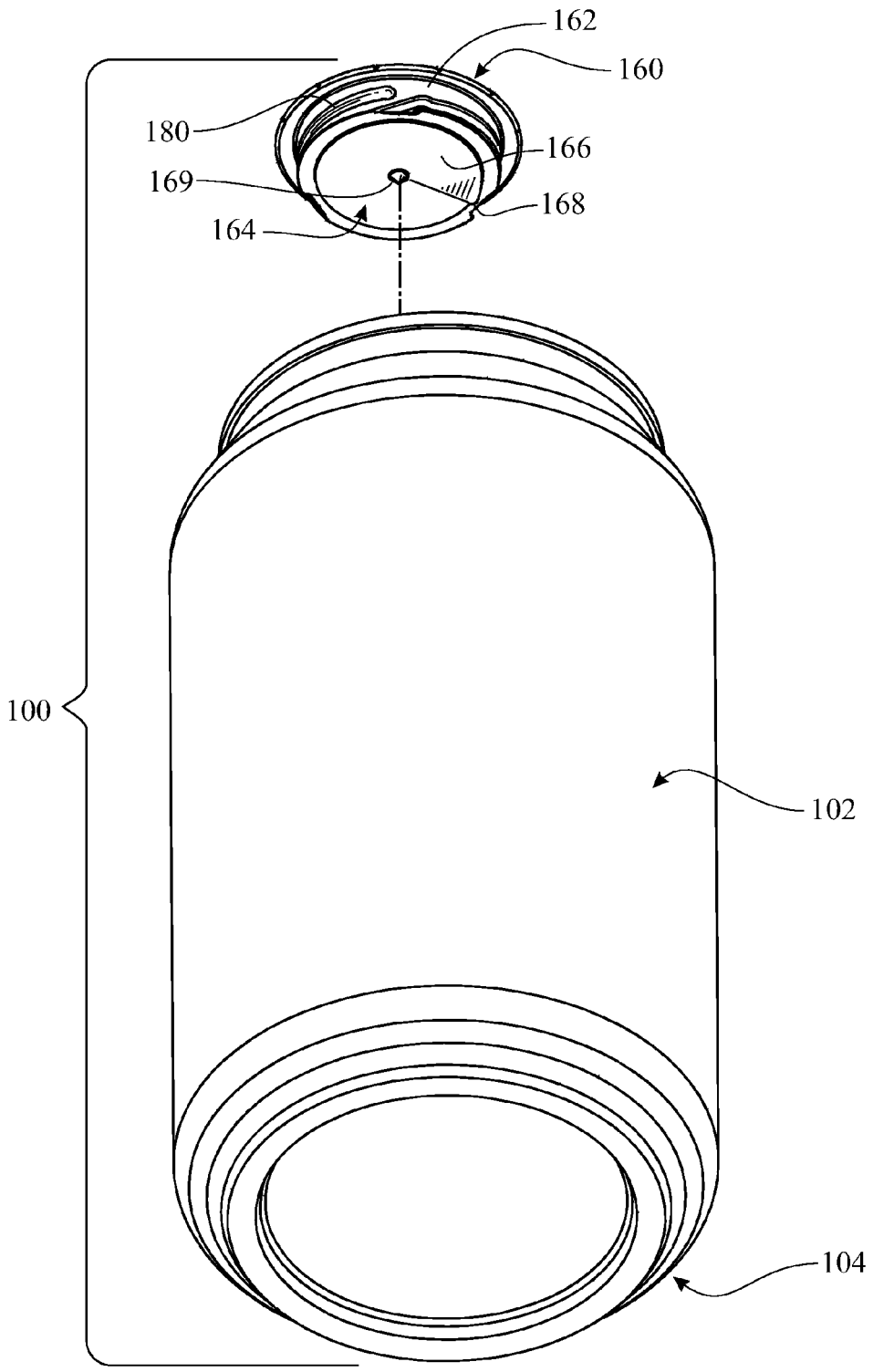
FIG. 4 presents a bottom isometric exploded assembly view of the container as shown in FIG. 2.
Figure 5:
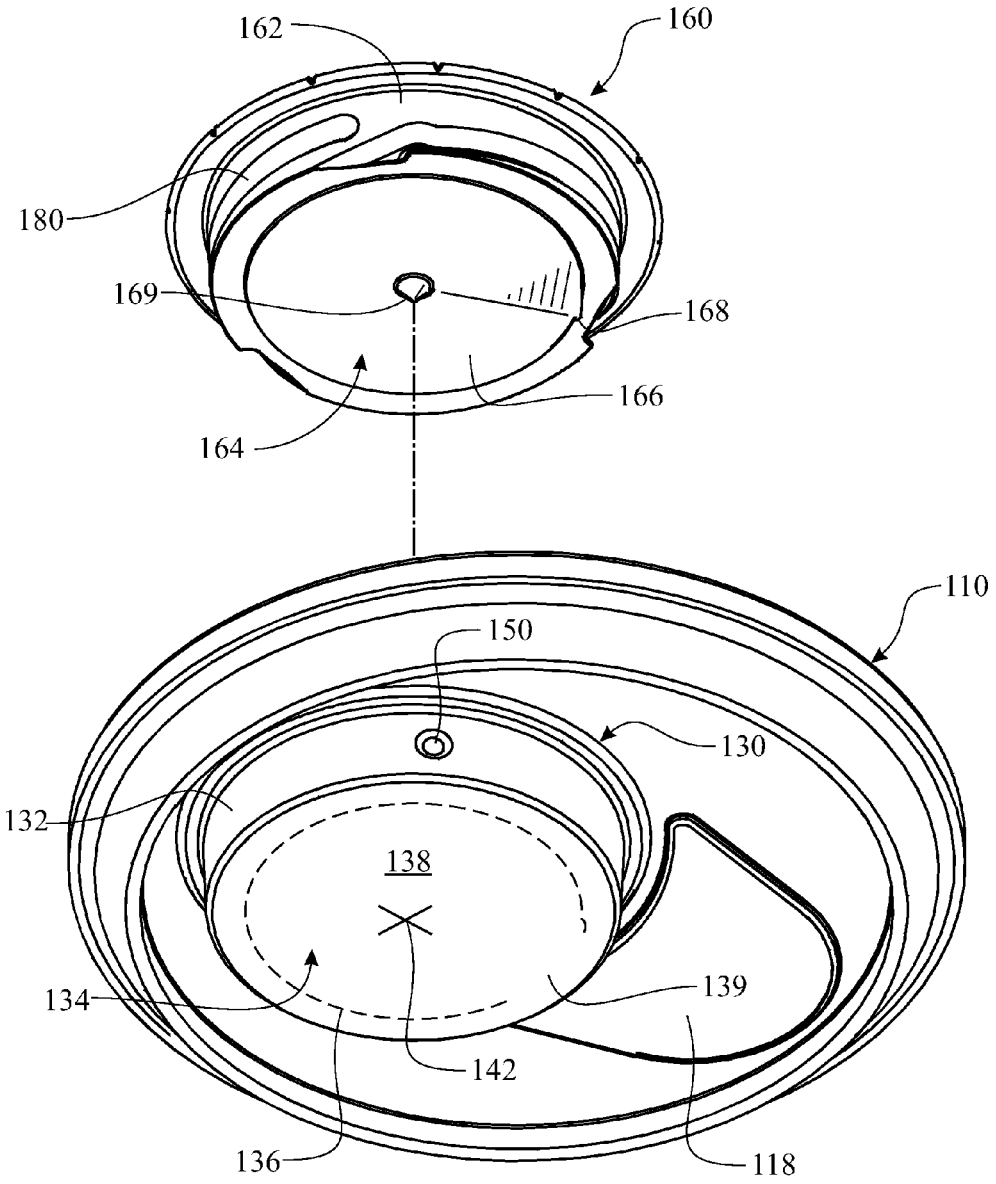
FIG. 5 presents an enlarged, bottom isometric exploded assembly view of the lid and the cap of the exemplary container introduced in FIG. 1.

As shown in FIGS. 2, 3 and 5, the cap receiving socket cylindrical sidewall 132 of the cap receiving socket 130 has a plurality of equally spaced socket sidewall cam engaging projections 150, disposed substantially on the same plane and being integrally formed in the sidewall 22. FIG. 5 shows one protrusion as an indentation or recess, since FIG. 5 shows the outer cylindrical sidewall 132 of the resealable container lid 110, whereas the other figures show the inner cap receiving socket cylindrical sidewall 132 of the resealable container lid 110. The socket sidewall cam engaging projections 150 cooperate with the resealable container cap 160 in a manner described below in order to open and reseal the container 100.

Figure 6:
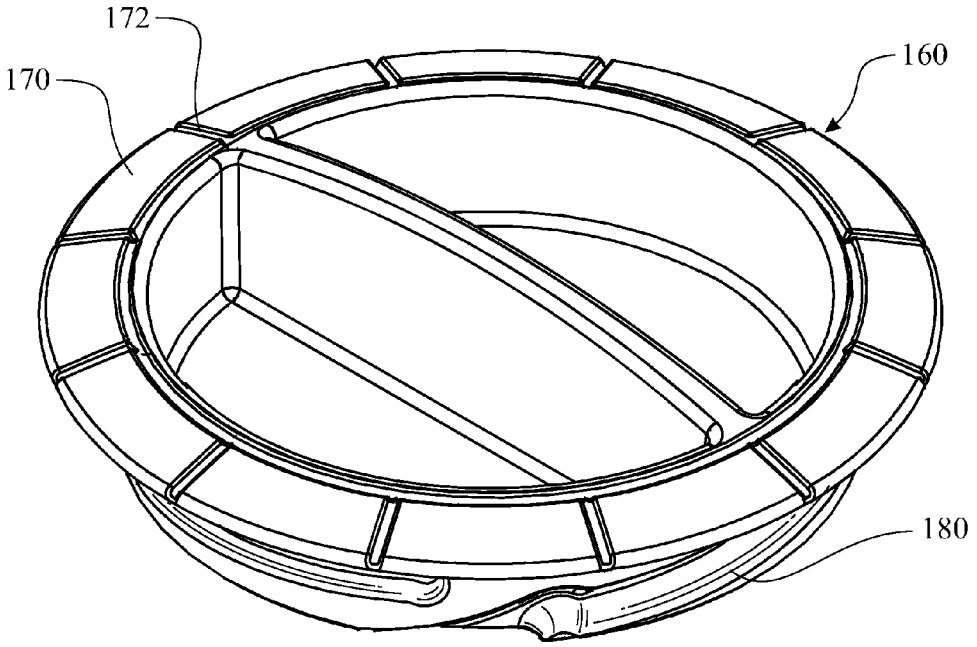
FIG. 6 presents an enlarged, top and side isometric view of the cap originally introduced in FIG. 1.
Figure 7:
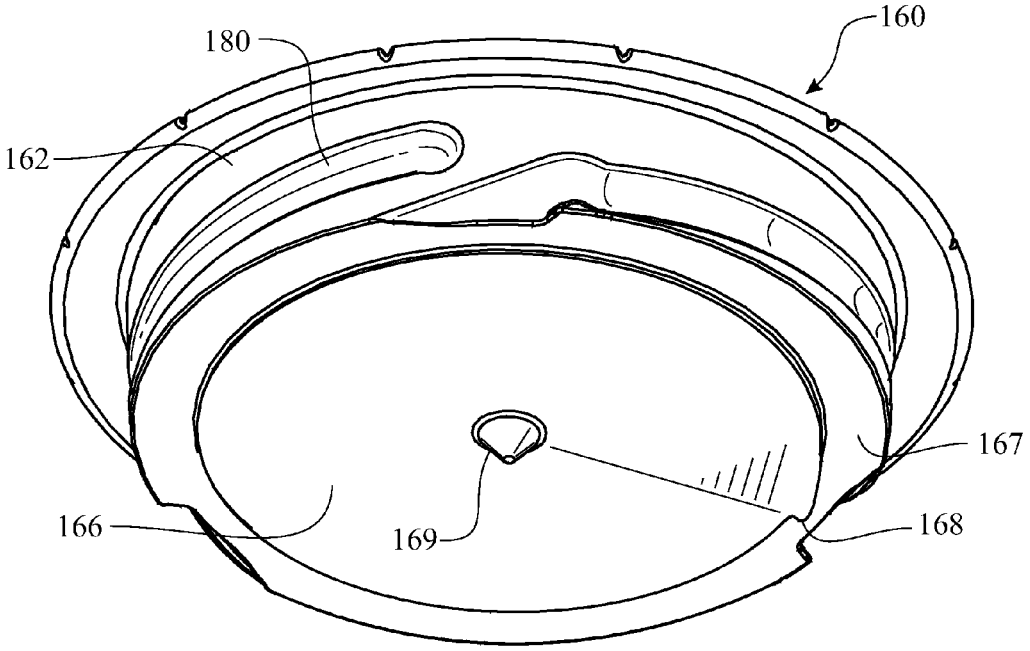
FIG. 7 presents an enlarged, bottom and side isometric view of the cap originally introduced in FIG. 1.

Referring to FIGS. 5-7, the resealable container cap 160 has an radially extending cap skirt 170 which acts as a tamper proof indicator. As seen in FIG. 1, prior to opening the container 100, the radially extending cap skirt 170 seats flush with the resealable container lid planar upper surface outer segment 119 of the resealable container lid 110. The skirt is integrally formed with the resealable container cap 160, which is preferably made of plastic material. The radially extending cap skirt 170 includes a series of radially extending cap skirt frangible score lines 172, extending radially outwardly, which are operable to break during the opening operation of the can. The breaking of the score lines 172 is effected by the skirt 170 being driven downwardly as the resealable container cap 160 is twisted or rotated and thereby advances downwardly into the cap receiving socket 130. Opening of the beverage container will thus be evident by the broken score lines 172 of the radially extending cap skirt 170, and preferably, by the sections of the radially extending cap skirt 170 that are formed by the broken score lines 172 extending at an angle upwardly, thus extending radially outwardly and radially upwardly.

The resealable container cap 160 is preferably made of a molded plastic material, is sized to fit substantially within the cap receiving socket 130, and includes a cam shaped cap bottom surface 166 formed at the lower or inner end of a resealable container cap cylindrical sidewall 162. The cam shaped cap bottom surface 166 may include an integrally formed sharp or pointed offset projecting incisor 168 disposed offset to the center axis of the resealable container cap 160 and extending downwardly into the cap receiving socket 130 when the resealable container cap 160 is assembled in the cap receiving socket 130. When assembled, the offset projecting incisor 168 is disposed immediately above the cap receiving socket bottom panel circular score line 136, so that when the resealable container cap 160 moves downwardly during opening of the container 100 offset projecting incisor 168 punctures the can at the beginning of the cap receiving socket bottom panel circular score line 136, next to the tear panel hinge 139, then progressively propagates the rupture along the cap receiving socket bottom panel circular score line 136 to its terminus on the opposite end of the tear panel hinge 139.

The cam shaped cap bottom surface 166 may also include a centered projecting incisor 169 disposed on the center axis of the resealable container cap 160 and extending downwardly into the cap receiving socket 130 when the resealable container cap 160 is assembled in the cap receiving socket 130. When assembled, the projection is disposed immediate above an Cap receiving socket bottom panel centered "X" shaped score line 142, so that when the resealable container cap 160 moves downwardly during opening of the container, the projection punctures the can at the Cap receiving socket bottom panel centered "X" shaped score line 142, thereby relieving internal pressure and assisting in the rupturing of the cap receiving socket bottom panel circular score line 136 by the offset projecting incisor 168.

The opening operation of the container 100 is made possible by forming a cam structure between the cap receiving socket 130 and the resealable container cap 160. In particular, cam groove surfaces 180 are formed in the resealable container cap cylindrical sidewall 162 of the resealable container cap 160. The socket sidewall cam engaging projections 150 are fitted into and engage the cam groove surfaces 180 such that when the resealable container cap 160 is hand-twisted by the consumer, rotational motion of the resealable container cap 160 is converted into linear motion of the resealable container cap 160 thus driving the cap in a downward direction relative to the cap receiving socket 130. As the resealable container cap 160 moves downwardly, the cap receiving socket bottom panel circular score line 136 is ruptured by the offset projecting incisor 168, then progressively propagates the rupture along the cap receiving socket bottom panel circular score line 136 to its terminus. In an alternate embodiment, an optional Cap receiving socket bottom panel centered "X" shaped score line 142 may be ruptured by the centered projecting incisor 169 immediately before the cap receiving socket bottom panel circular score line 136 is ruptured by the offset projecting incisor 168, to thereby relieve internal pressure and assist in the rupture of the cap receiving socket bottom panel circular score line 136 by the offset projecting incisor 168.

Figure 8:
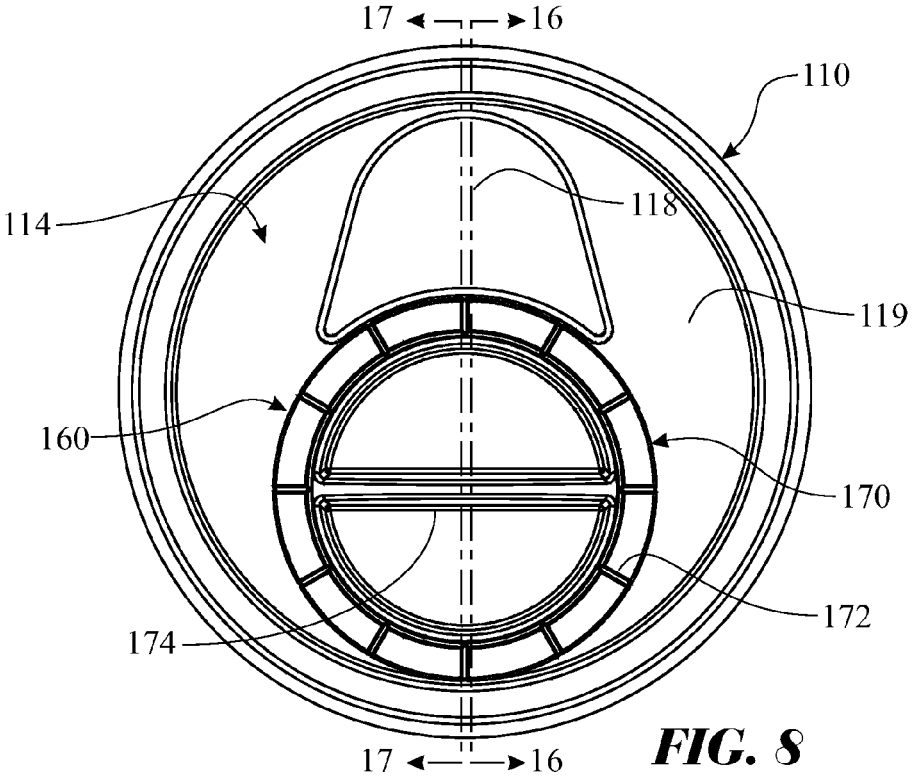
FIG. 8 presents a top view of the exemplary container originally introduced in FIG. 1, wherein the illustration includes the cap shown in an un-opened position.

As shown in FIG. 8, the resealable container cap 160 includes a resealable container cap grip element 174 for the consumer to grab when ready to open the beverage container, and also, as described below, for resealing the beverage container after opening. Depending on the contour of the cam surfaces and their direction of orientation, the cap can be rotated in one direction, preferably clockwise for opening, and then in the opposite direction, counterclockwise, to remove the cap during consumption of beverage, and then again back to the can-opening direction for resealing the beverage container if the contents are not entirely consumed. Symmetry of disposition of the three socket sidewall cam engaging projections 150 is shown in FIG. 9, wherein the three socket sidewall cam engaging projections 150 are located at approximately equal angular intervals of 120 degrees. Each projection engages a corresponding cam groove surface 180, more specifically, a first cam groove surface 181, a second cam groove surface 182, and a third cam groove surface 183. As shown in the illustrated embodiment, the resealable container cap cylindrical sidewall 162 of the resealable container cap 160 would be contoured, as by forming grooves, to form three cam groove surfaces 181, 182, 183. The cam surfaces or features 181, 182, 183 are shaped and sloped in a manner designed to cause the resealable container cap 160 to advance into an opening position without more than a quarter to half a turn, and as measured in radians, this would be no more than 1 to 2 radians. The number of projections and cam elements can be varied, although three provides a balance between cost and effectiveness.

Figure 10:
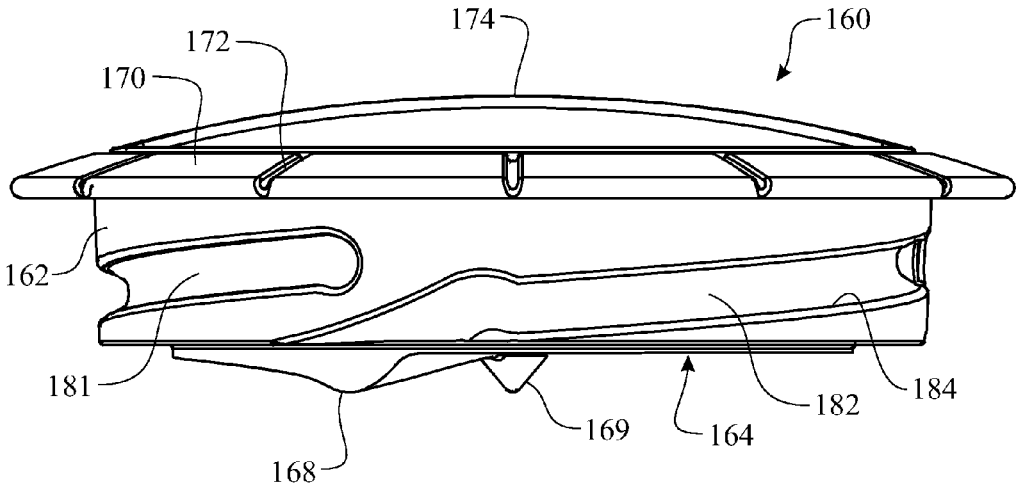
FIG. 10 presents an enlarged side elevation view of the cap, wherein the illustrations present details of the cam groove surfaces formed on a cylindrical sidewall of the cap.
Figure 11:
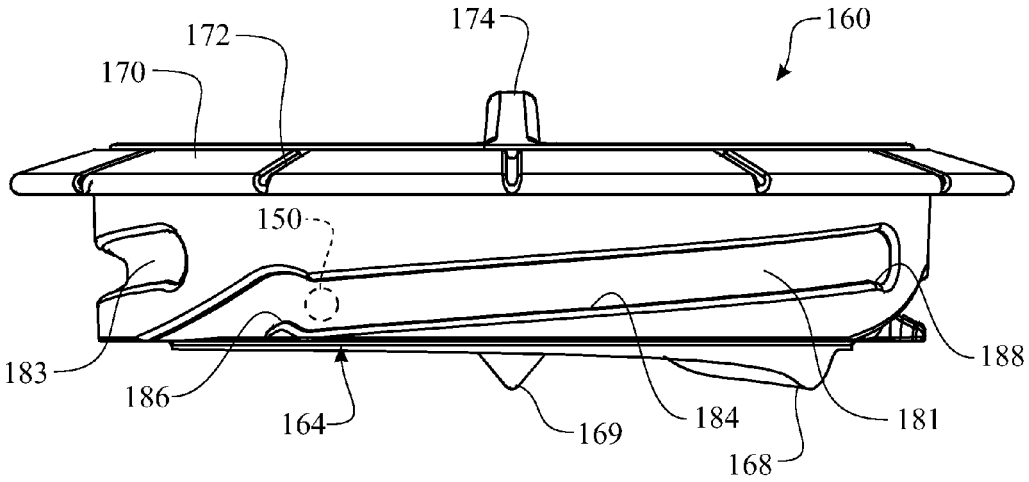
FIG. 11 presents an enlarged side elevation view of the cap FIG., wherein the illustration presents the cap rotated ninety degrees (90°) from the illustration presented in FIG. 10.
Figure 12:
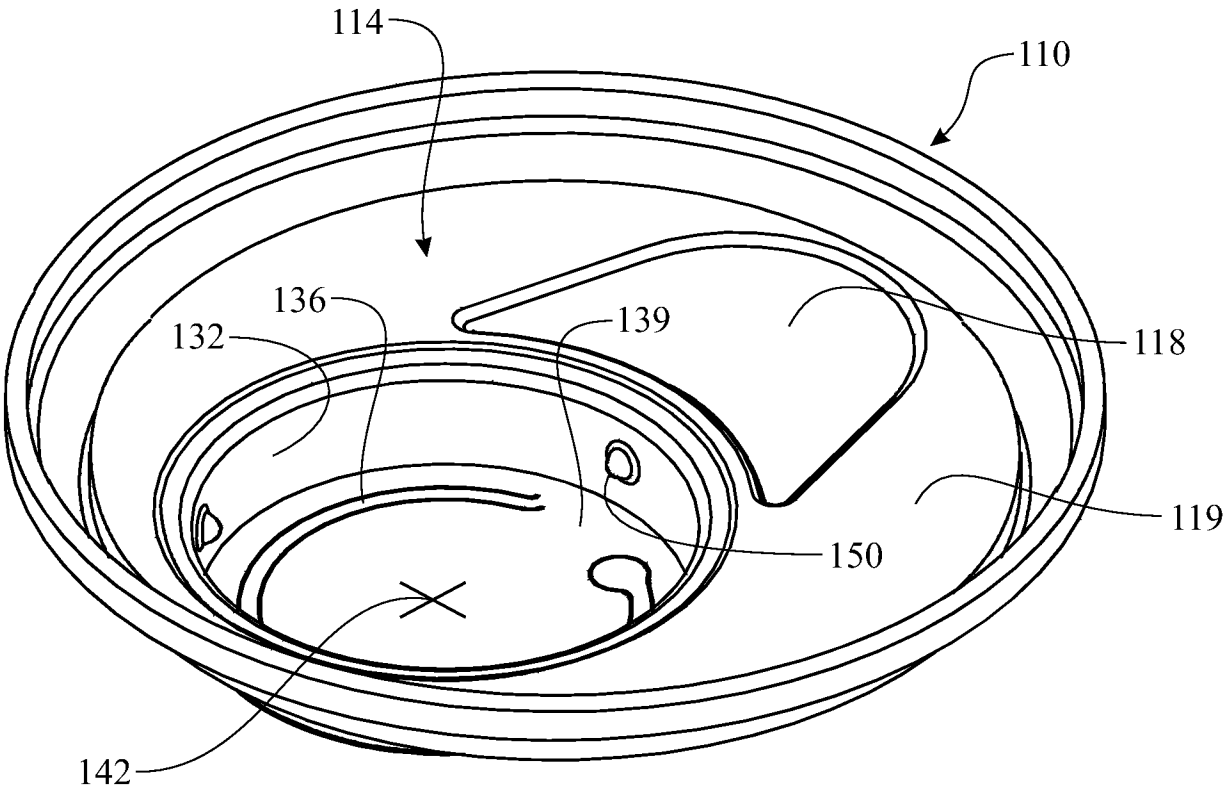
FIG. 12 presents a top isometric view of the resealable container lid, wherein the illustration excludes the cap to expose features of the socket.

The cap resealable container cap cylindrical sidewall 162 includes three equally spaced cam groove surfaces 181, 182 and 183, as best shown in FIGS. 10 and 11. The cam groove surfaces 181 and 182 and the resealable container cap grip element 174 extending across the page are best illustrated in FIG. 10. The resealable container cap bottom surface 164 of the resealable container cap 160 includes the centered projecting incisor 169, acting as a piercing element, which punctures the cap receiving socket bottom panel centered "X"

shaped score line 142, and it further includes a further offset projecting incisor 168 which also acts as a piercing element. The projection 168 is designed and shaped to impinge on the cap receiving socket bottom wall 134 of the cap receiving socket 130 inside and juxtaposed the cap receiving socket bottom panel circular score line 136. As the resealable container cap 160 is rotated, from the unopened position shown in FIG. 10, the cam structure turns the rotational movement to translational movement, thus moving the cap inwardly. As the resealable container cap 160 moves inwardly, the offset projecting incisor 168 rotates until, preferably, it reaches the position shown in FIG. 11, wherein a portion of the cap receiving socket bottom wall 134 breaks away and is pushed inwardly to form the cap receiving socket bottom panel tear panel 138 that remains hinged to the cap receiving socket bottom wall 134 by virtue of the cap receiving socket bottom panel circular score line 136 not extending to a complete loop. The offset projecting incisor 168 starts at the beginning of the cap receiving socket bottom panel circular score line 136 and only travels ninety degrees (90°). Thus, offset projecting incisor 168 will only have traveled a portion of the length. What pushes the cap receiving socket bottom panel tear panel 138 out of the way is the body of the cam shaped cap bottom surface 166 going past the plane of the cap receiving socket 130 cap receiving socket bottom wall 134. Notice that the cam shaped cap bottom surface 166 protrudes out from the flat annular cap bottom sealing surface 167.

Figure 13A:
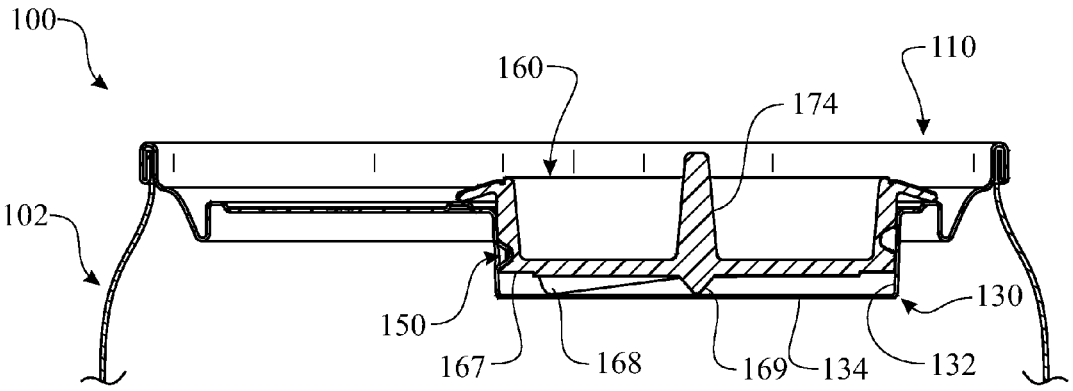
FIG. 13A presents a cross sectional elevation view of the cap in a sealed condition, following bottling, and prior to fracturing a score line to open the container.

Cross sectional views of the cap moving between opening and resealing positions are shown in FIGS. 13A through 13D. In FIG. 13A, the resealable container cap 160 is shown in cross section prior to opening the beverage container. Thus, the cap receiving socket bottom wall 134 of the cap receiving socket 130, the cap receiving socket cylindrical sidewall 132 of the cap receiving socket 130, and the resealable container lid upper surface 114 form the resealable container lid 110. The resealable container cap 160 is shown in the storage position, i.e., pre-opening of the can, in FIG. 13A, wherein the cap receiving socket bottom wall 134 is not punctured and the contents of the container 100 are air tight for potentially long term storage. The resealable container cap grip element 174 is shown in a first, unopened position. In this position the flat annular cap bottom sealing surface 167 of the resealable container cap 160 is spaced above the socket cap receiving socket bottom wall 134, but the offset projecting incisor 168 is close to or in slight contact with the cap receiving socket bottom panel circular score line 136. Similarly, if a second centered projecting incisor 169 is employed at the center of the lower end of the resealable container cap 160, it is also disposed in close proximity to the score line 44 if not slightly touching.

Figure 13B:
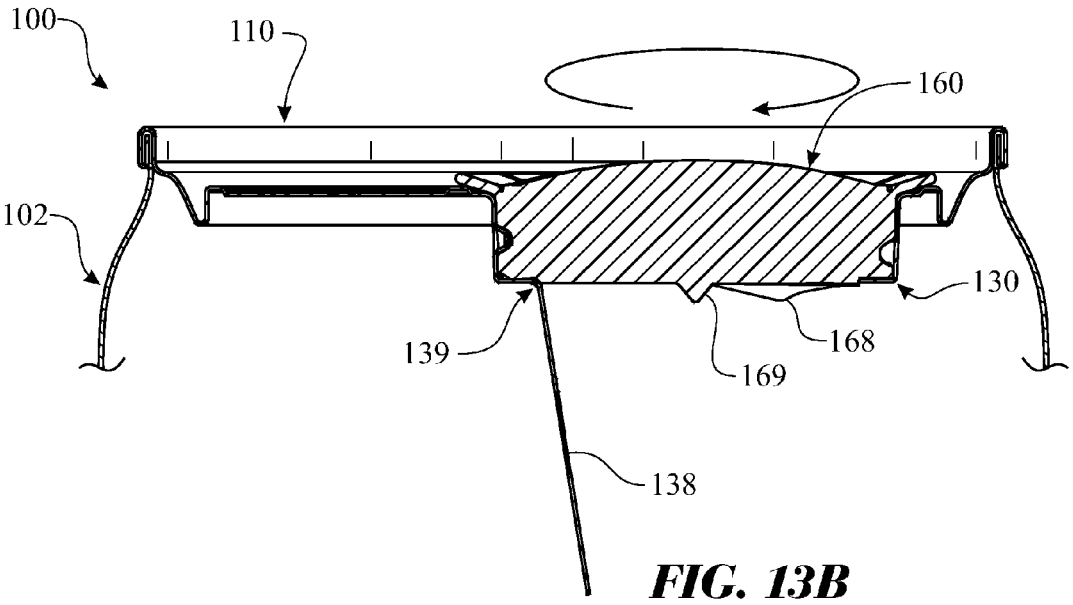
FIG. 13B presents a cross sectional elevation view of the cap, wherein the illustration demonstrates a first step in use, wherein the cap is rotated to open the container.

The resealable container cap 160 is rotated clockwise approximately ninety degrees) (90°, as shown in FIG. 13B. Engagement between the cam groove surfaces 180 and the socket sidewall cam engaging projections 150 translates the resealable container cap 160 downwardly by a distance sufficient to cause the offset projecting incisor 168 to rupture the cap receiving socket bottom panel circular score line 136 as the projection moves along the inner side of the score line. The rupture creates a cap receiving socket bottom panel tear panel 138 which is pushed by the offset projecting incisor 168 into the interior of the container 100 by rotating downwardly about a tear panel hinge 139, wherein the tear panel hinge 139 is formed spanning between opposite ends of the cap receiving socket bottom panel circular score line 136. The opposite ends of the score line 136 are positioned to locate and define a pivot axis of the tear panel hinge 139 for the cap receiving socket bottom panel tear panel 138.

Figure 13C:
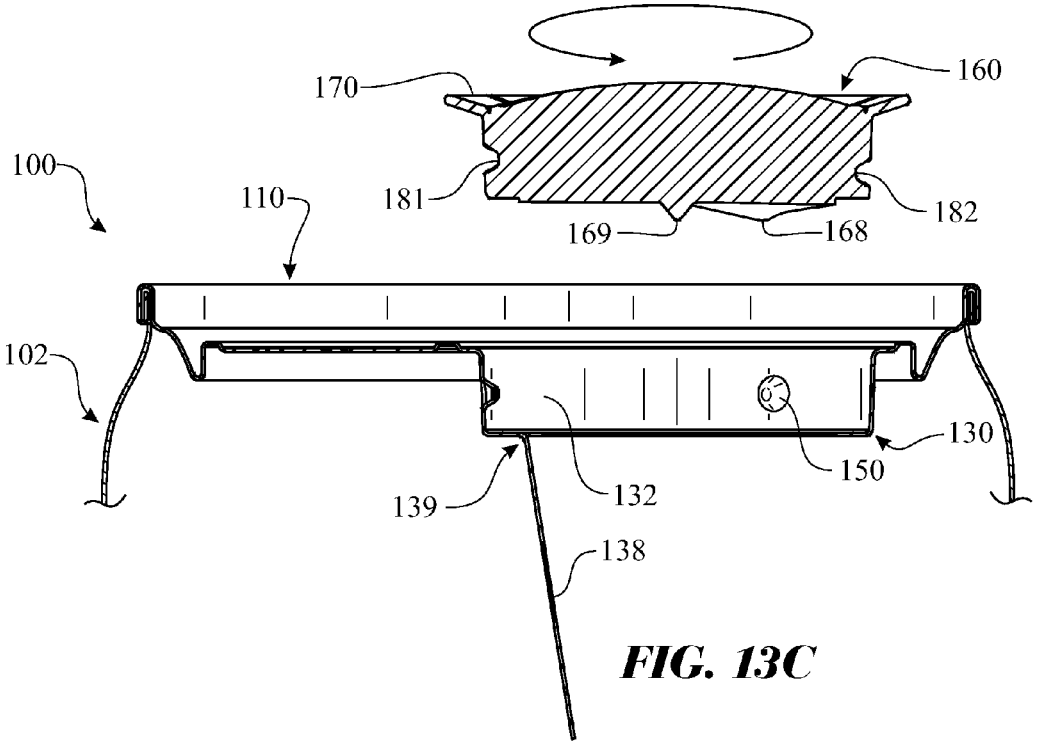
FIG. 13C presents a cross sectional elevation view of the cap, wherein the illustration demonstrates a second step in use, wherein the cap is removed from the lid of the container enabling dispensing and consumption of contents stored within the container.

After the cap receiving socket bottom panel tear panel 138 is formed, and the resealable container cap 160 is disposed at its innermost position relative to the socket, the consumer would then rotate the resealable container cap 160 counterclockwise, preferably by turning the resealable container cap grip element 174. The resealable container cap 160 is shown in FIG. 13C being separated from the container 100, and can be pocketed by the consumer, or placed in a location for easy access in case the consumer chooses not to consume the entire contents of the container 100. As evidence that the beverage container has been opened, the radially extending cap skirt 170 may be angled upwardly as a result of the frangible score lines being broken, so that individual sections of the skirt are now biased in an upward direction. Also, when rotating counterclockwise, the cam groove surfaces 180 and the socket sidewall cam engaging projections 150 will eventually separate, allowing the resealable container cap 160 to be free of the container 100.

Figure 13D:
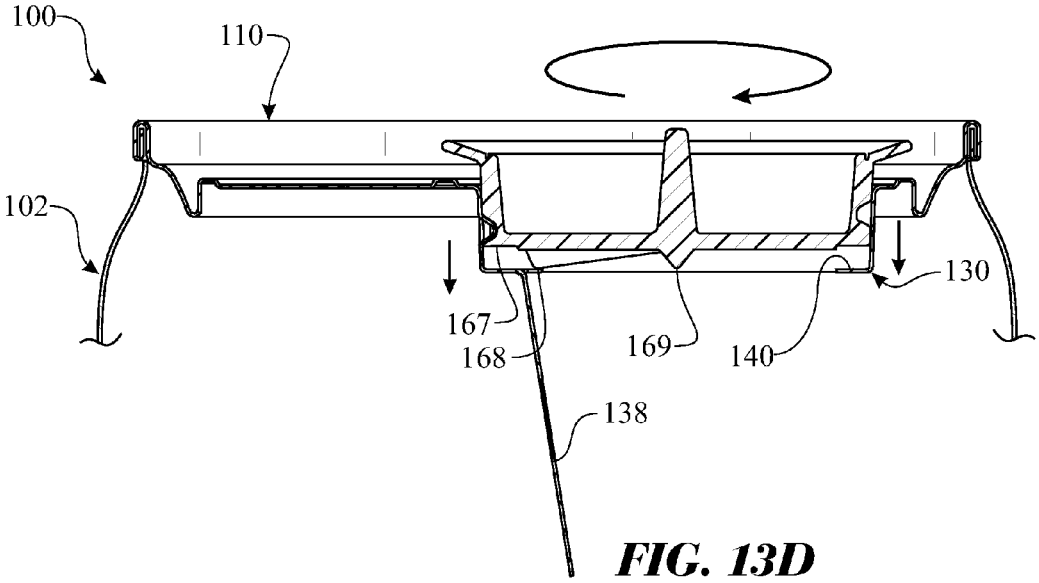
FIG. 13D presents a cross sectional elevation view of the cap, wherein the illustration demonstrates a third step in use, wherein the cap is replaced upon the lid of the container sealing any remaining contents within the container.

In the event that the consumer wishes to reseal the container 100, and as shown in FIG. 13D, the resealable container cap 160 is brought into contact with the cap receiving socket 130 by the consumer, by bringing the cam groove surfaces 180 into engagement with the socket sidewall cam engaging projections 150. Once this occurs, clockwise rotation will cause the resealable container cap 160 to translate downwardly until a sealing, seating arrangement is made between the cap receiving socket bottom panel flat annular surface 140 of the socket cap receiving socket bottom wall 134 and the flat annular cap bottom sealing surface 167 of the resealable container cap 160, thereby keeping the contents of the container 100 fresh and safe from foreign contaminants. The seal will retain carbonation when the contents are carbonated.

The resealable container cap 160 can be removed again and again to gain access to the contents of the beverage container until all contents are consumed. There is no limit to the type of beverages or other contents that can be housed in the container 100, but most commonly "canned" beverages include sodas, beer, juices, etc. It is also within the scope of the present invention that the contents of the containers could be foodstuff, and non-consumable liquids, gels, powders, and the like.

The cam means disclosed herein can be used for caps that provide other functionality for the container 100. For example, a variation of the resealable container cap 160 would be one that could include a passageway extending through the resealable container cap 160 with drinking implements formed at the upper, outer end, such as a child's sip cup, which would allow a child to drink from the container 100 without spilling. Alternatively, the resealable container cap 160 could be formed with an infant nipple for feeding formula, juice, water or other beverages suitable for infants. When using drinking implements such as sip cup and baby bottle nipples, a resealable container cap 160 would nonetheless have to be employed for opening the container, and then a second "cap" could be used for consuming the contents. In any event, the opening caps and drinking implements could be sold separately from the container 100, as long as the container 100 included the socket sidewall cam engaging projections 150 formed in the cap receiving socket cylindrical sidewall 132 of the cap receiving socket 130.

Although a wide range of plastic materials could be used to form the resealable container cap 160, other materials could be used, including ceramics and metals. However, for harder materials such as these, it may be necessary to position a gasket between the opposing annular surfaces 140, 167 of the socket 130 and the cap 160, respectively to ensure the best possible seal.

While the embodiments described herein place the socket 130 and cap 160 in the top of the container 100, it is possible to have the same opening and resealing structures in the container closed bottom wall 104 of the container 100. Also, while a cylindrical container 100 has been described herein, other shapes of containers, e.g., oval, rectangular, hexagonal, octagonal, and the like, could also be used.

The preferred shape of the frangible cap receiving socket bottom panel circular score line 136 in the bottom of the cap receiving socket 130 is circular, with a closed end and an open end. The inside score (shallower line) terminates in a curve arcing towards the socket's cylindrical sidewall to prevent loss of tear panel into the container. The outside score line (deeper line) terminates in circular form spaced from the inside score line. There is a hinged portion of the tear panel that keeps the panel in contact with the lid once ruptured, as described above.

The offset projecting incisor 168, described as a piercing element, is intended to be a single point of contact that moves deeper, and radially along the inside of the cap receiving socket bottom panel circular score line 136 while the resealable container cap 160 is rotated. The offset projecting incisor 168 may also include additional areas to further drive the cap receiving socket bottom panel tear panel 138 deeper into the container. A single point will apply more force to breaking the cap receiving socket bottom panel circular score line 136 defining the cap receiving socket bottom panel tear panel 138 but additional areas acting in a secondary fashion could help in the opening process.

The socket sidewall cam engaging projections 150 used in the cap receiving socket 130 allow the use of a very shallow socket 130 (as compared to threaded designs) and still provide positive opening, closing and sealing of the resealable container cap 160. The design of the socket sidewall cam engaging projections 150 also provides for positive stops for open, closed and removable cap positions. As seen in FIGS. 10 and 11, each cam groove surface 181, 182, 183 includes a sloped cam groove surface segment 184, a cam groove surface lower detent 186 and an cam groove surface upper detent 188. Once assembled, the three socket sidewall cam engaging projections 150 are respectively positioned so that the detents prevent the resealable container cap 160 from becoming disconnected from the cap receiving socket 130, during transport or storage, and from backing off a sealing position, when the resealable container cap 160 is positioned in a resealing position. This can be illustrated with reference to FIG. 11, where the socket sidewall cam engaging projection 150 is shown as a broken line circle. When the resealable container cap 160 is in the unopened position, each socket sidewall cam engaging projection 150 (shown as a broken line circle) will be positioned next to the cam groove surface lower detent 186. The cam groove surface lower detent 186 prevents the resealable container cap 160 from turning to a position where the socket sidewall cam engaging projection 150 is disengaged from the third cam groove surface 183, as for example, if vibration or the like caused the projection to pass out of the sloped cam groove surface segment 184. Similarly, when the resealable container cap 160 is intentionally rotated clockwise, to either open or reseal the beverage container, the projection passes over the cam groove surface upper detent 188 to become locked by interference fit between the cam groove surface upper detent 188 and the socket sidewall cam engaging projection 150. The cam groove surface upper detent 188 thus prevents the resealable container cap 160 from inadvertently backing out from the sealing position. Thus, the resealable container cap 160 is held in two positions by the detents 186, 188. The first position can be referred to as a transport securement position and the second position can be referred to as a closed position. The distance between the two detents, measured along the rotational axis of the resealable container cap 160 is equal to the distance between the resealing surface on the resealable container cap 160 and the associated surface of the cap receiving socket bottom wall 134. The transport securement detent, or cam groove surface lower detent 186 restricts the rotary movement of the resealable container cap 160 due to the interference between the stabilizing radially extending cap skirt 170 and the flat upper rim of the resealable container cap 160, as well as the interference between the piercing element or offset projecting incisor 168 and the socket cap receiving socket bottom panel tear panel 138.

When turning the resealable container cap 160 in the opening direction, e.g., clockwise, the socket sidewall cam engaging projections 150 on the socket's cylindrical sidewall follow the sloped cam groove surface segments 184 of the cam groove surfaces 180, which form gradual ramps, converting the rotary motion of the resealable container cap 160 to a linear or translational movement, which drives the resealable container cap 160 into the interior of the container 100. This engages the offset projecting incisor 168 against the cap receiving socket bottom panel tear panel 138 and provides the force necessary to rupture the cap receiving socket bottom panel circular score line 136. Further turning of the resealable container cap 160 in the opening direction progressively pushes the cap receiving socket bottom panel tear panel 138 out of the way and into the interior of the container 100, until the socket sidewall cam engaging projections 150 reach the closed position of the cam groove surface upper detents 188. A slightly higher point on the sloped cam groove surface segment 184 of the cam groove surfaces 180 just before the closed position provides the resistance necessary to keep the resealable container cap 160 from backing out.

When turning the resealable container cap 160 opposite the opening direction, the socket sidewall cam engaging projections 150 follow the same route to their starting positions but after opening, the socket sidewall cam engaging projections 150 can pass over the transport securement or cam groove surface lower detents 186 because the stabilizing radially extending cap skirt 170 and the cap receiving socket bottom panel tear panel 138 are now not providing any interference between the transport securement or cam groove surface lower detents 186 and the void between the cam groove surfaces 180, allowing the resealable container cap 160 to be freed from the container.

In the embodiments described and illustrated herein, the exemplary cam groove surfaces 180 are shown as grooves having a sloped segment that terminates at opposite lower and upper ends in a lower and an upper detent 186, 188 (respectively), whereby the entire cam groove surfaces or elements 181, 182, 183 were formed in the resealable container cap cylindrical sidewall 162 of the resealable container cap 160. It is equally possible to form the cam groove surfaces or elements 181, 182, 183 as projections or bosses from the surface, integrally formed therewith, or as separate parts connected to the resealable container cap 160. Further, while the socket sidewall cam engaging projections 150, acting as cam followers, project from the cap receiving socket cylindrical sidewall 132 of the cap receiving socket 130, the cap receiving socket 130 could have been formed with cam surfaces 181, 182, 183 and the cam followers or cam engaging projections 150 could have been formed on the resealable container cap 160. The exact size and shapes of the cam surfaces 181, 182, 183 can be selected to correspond to the particular needs of the container 100. The overall goal is to select a structure that results in an operable torque which can be applied by consumers without exerting excessive effort.

Figure 14:
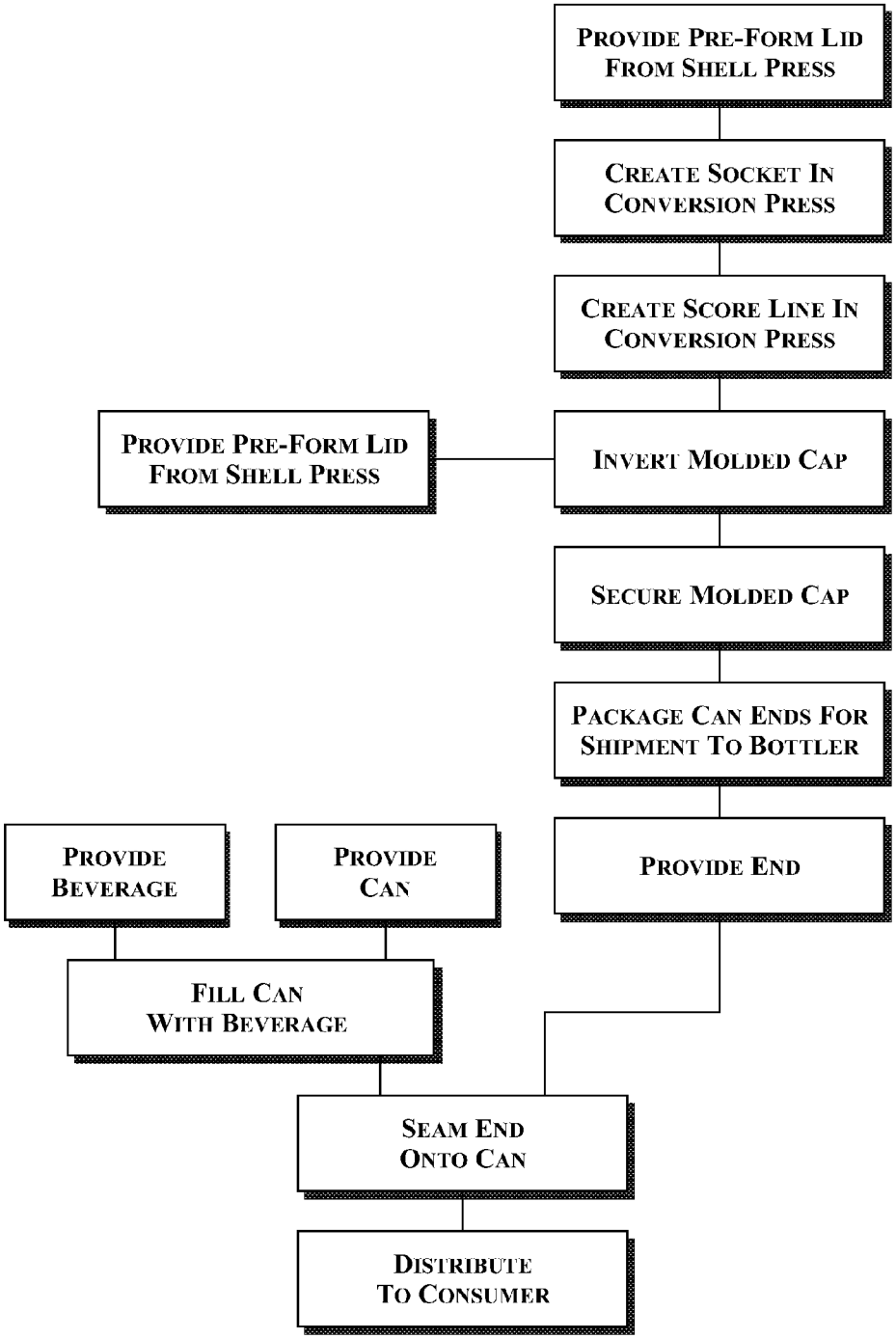
FIG. 14 presents an exemplary flow chart defining steps of manufacturing the resealable lid and the associated container according to one embodiment of the present invention.

The structures described above can be made using unique manufacturing processes, which combine some of the known processing steps with new, modified or avoided steps. In one particularly preferred method of making containers 100, as illustrated in the flow chart of FIG. 14, preformed resealable container lids 110 are provided from a shell press. Next, cap receiving sockets 130 are formed in the resealable container lids 110 using a conversion press. Next, a score line is formed in the bottom of the cap receiving socket 130 in the conversion press, either at the same time, or sequentially after the cap receiving socket 130 is formed. Resealable container cap 160 are formed by injection molding, or other suitable means, and the resealable container caps 160 are supplied to the assembly line, where they are inserted into the sockets. The resealable container caps 160 are then secured to the sockets by press forming the projections by spacing three dies around the socket, all centered on a common plane. The dies are pressed inwardly against the cylindrical sidewall of the cap receiving socket 130, and the resealable container cap 160 acts as a mandrel against the inner pressing force of the dies, thus forming the socket sidewall cam engaging projections 150 to project into the grooves of the cam groove surfaces 180. The resealable container lids 110 or ends are then packaged and sent to bottlers, who can then use conventional processing steps to secure the lid to any of a variety of cans or other beverage containers.

The process described above achieves several cost and environmental advantages over the prior manufacturing techniques. First of all, the lid does not have to be processed to form a rivet, which has conventionally been used to secure a pull tab to a can lid. There is no need for a rivet because there is no need for the pull tab. The rivet required the lid to be made of stronger, thicker material, usually consisting of a different alloy of aluminum as opposed to the material that made up the sidewall and bottom. Moreover, the conventional process would have required the formation of a pull tab, likely to be made of third, different aluminum alloy. Use of three different aluminum materials presented a problem for recycling, whereas in the present invention, a single material can be used to form the can body and the can lid.

Figure 15:
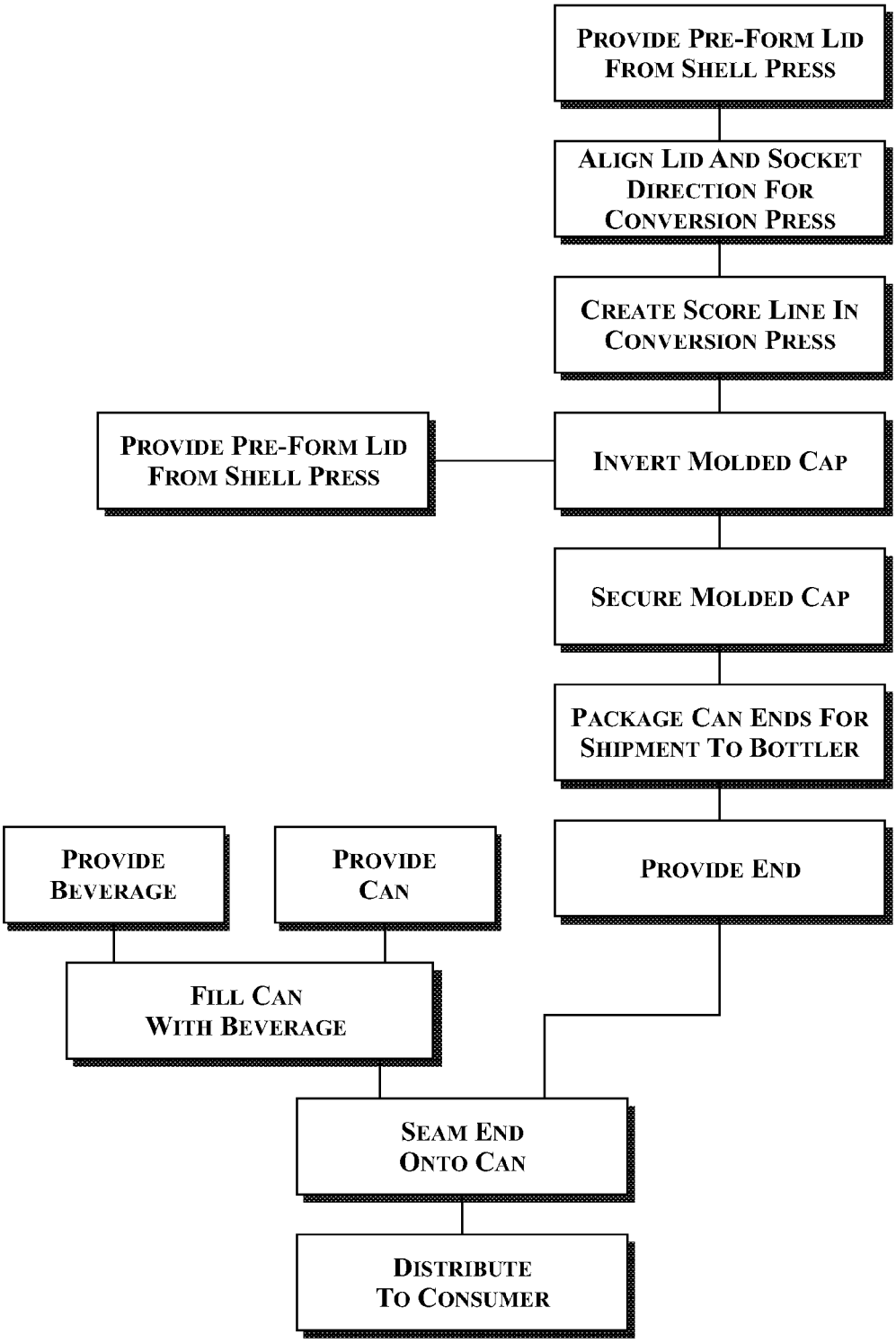
FIG. 15 presents an exemplary flow chart defining steps of manufacturing the resealable lid and the associated container according to a variant thereof.
Figure 16:
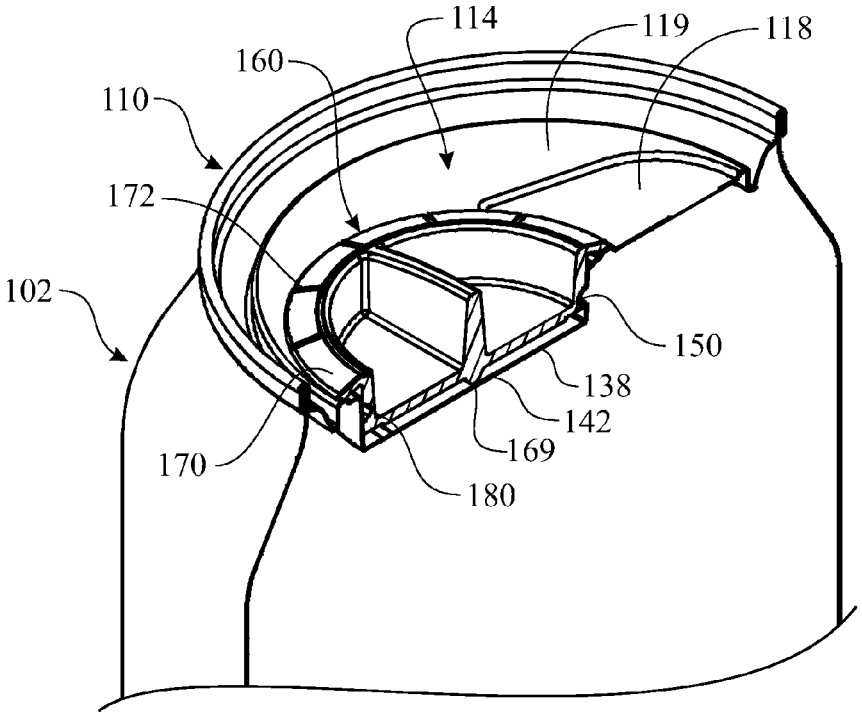
FIG. 16 presents a sectioned isometric view of the container, the section being taken along section line 16-16 of FIG. 8, wherein the illustration presents the container in an assembled, sealed configuration.
Figure 17:
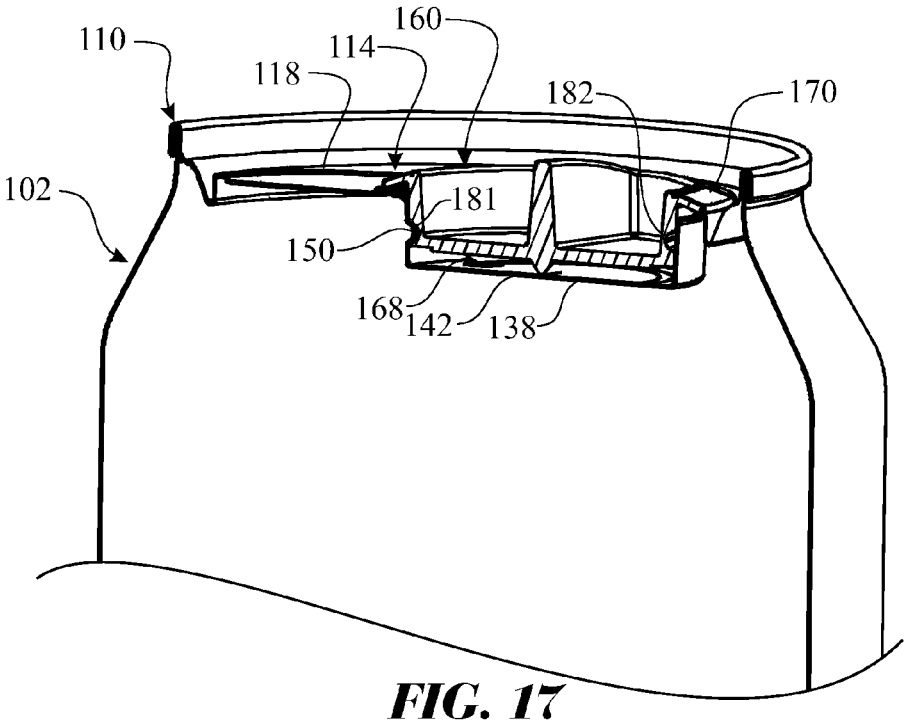
FIG. 17 presents a isometric view of the container FIG. 16, the section being taken along section line 17-17 of FIG. 8.
Figure 18:
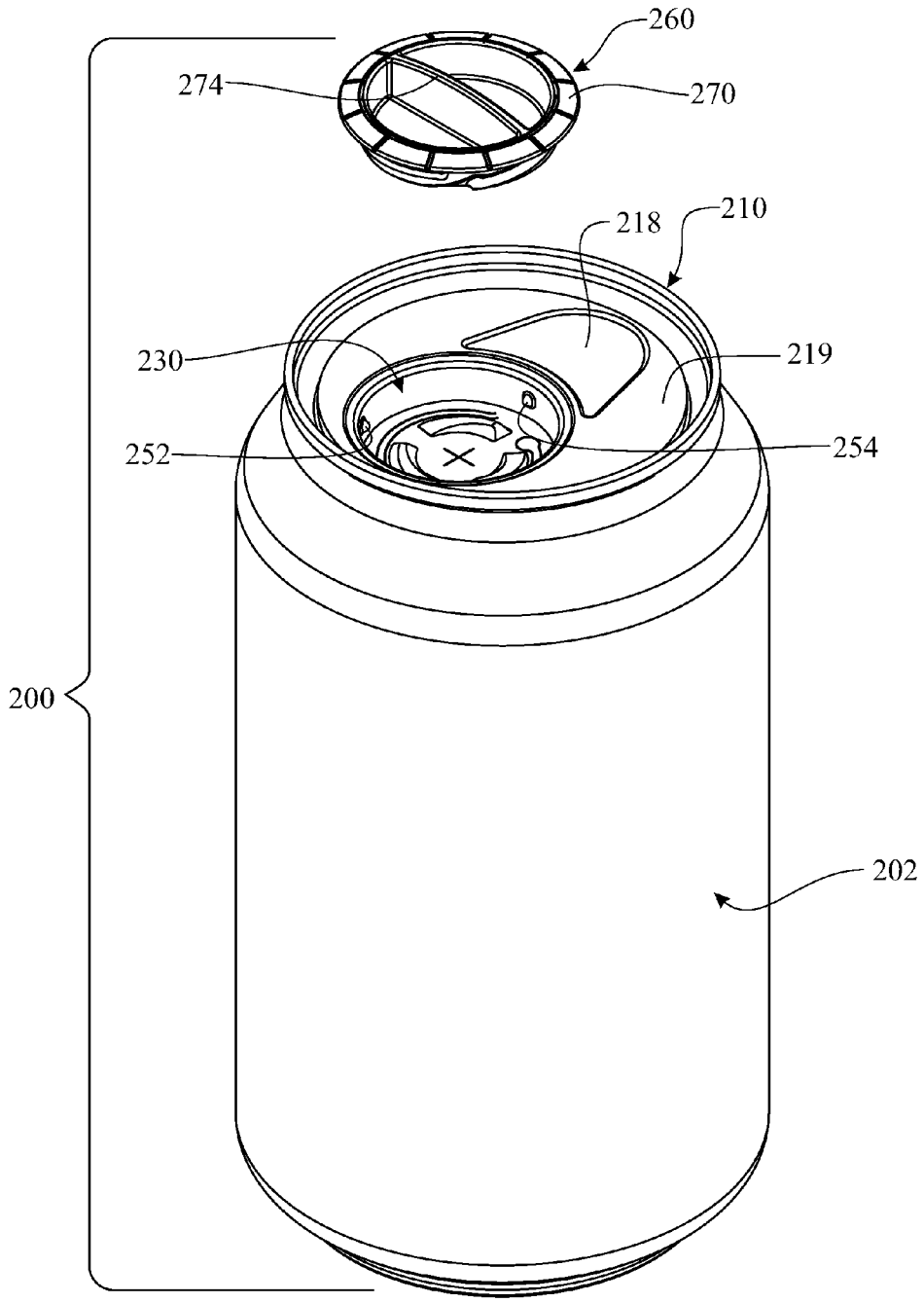
FIG. 18 presents a side isometric view of a second exemplary container introducing a variant of the present invention.
Figure 19:
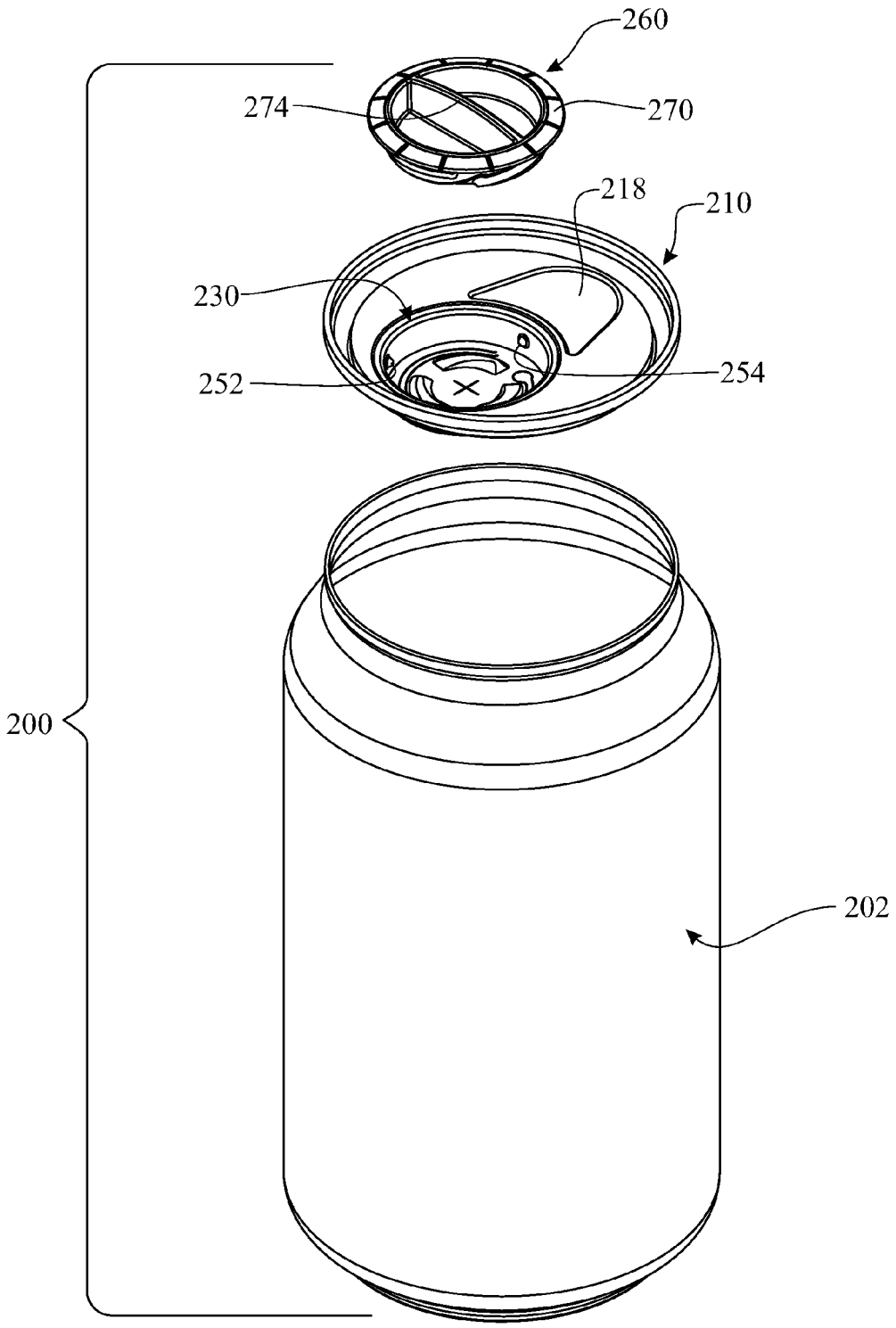
FIG. 19, presents a top and side isometric exploded assembly view of the container originally introduced in FIG. 18, wherein the illustration introduces the components of the container.
Figure 20:
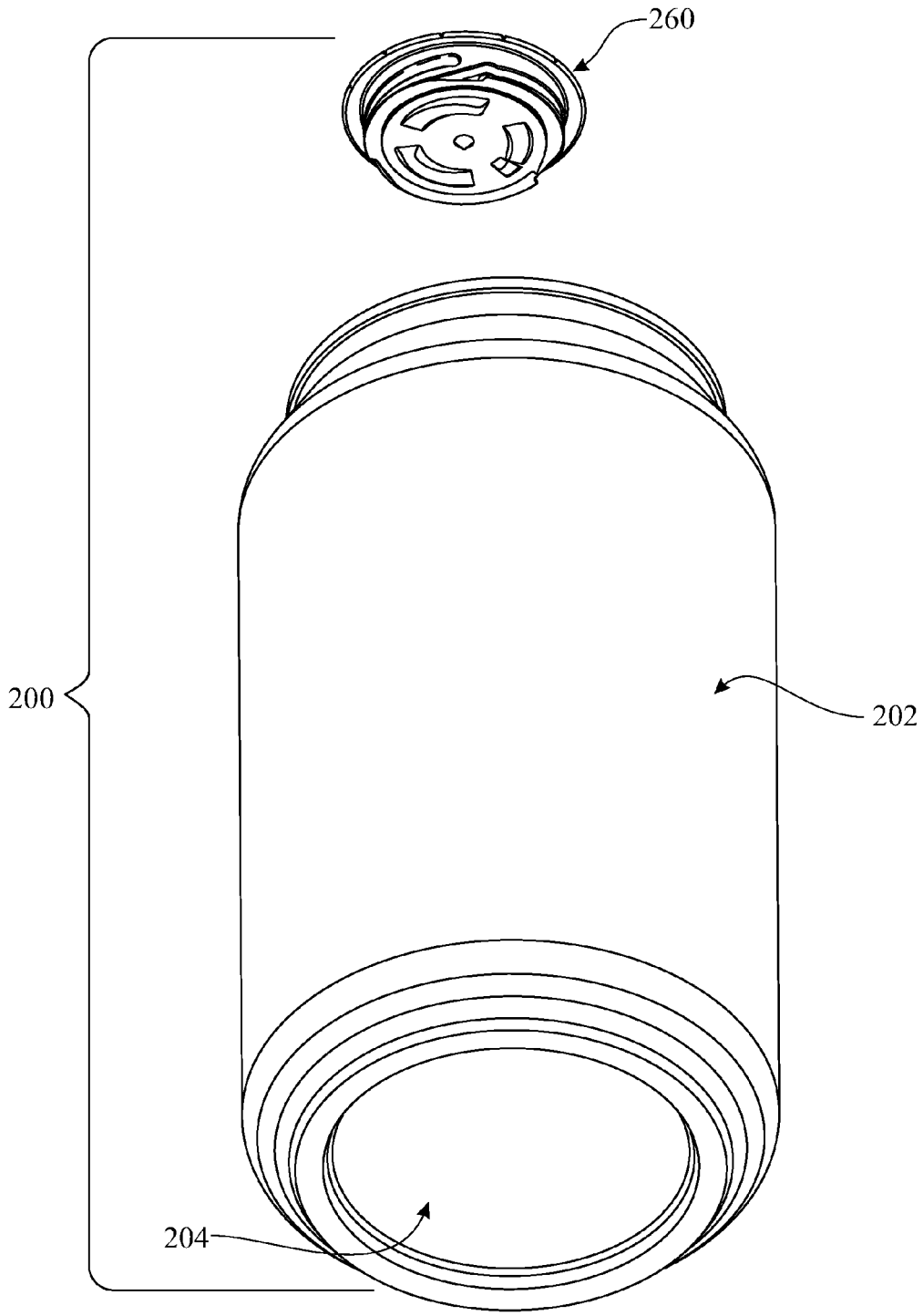
FIG. 20 presents a bottom and side isometric partially exploded assembly view of the container originally introduced in FIG. 18, wherein the cap is separated from the lid of the container to introduce features thereof.
Figure 21:
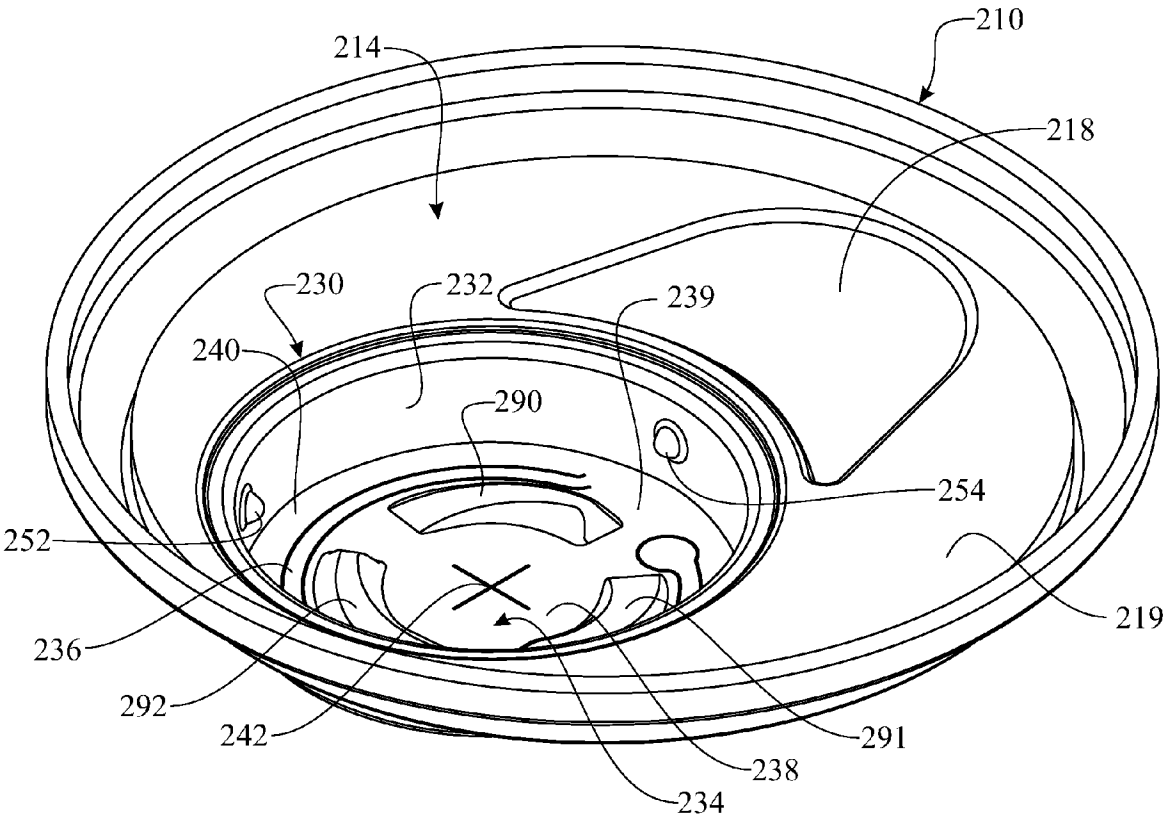
FIG. 21 presents an enlarged, isometric top view of the lid, of the container originally introduced in FIG. 18, wherein the lid is illustrated exclusive of the cap to introduced details thereof.
Figure 22:
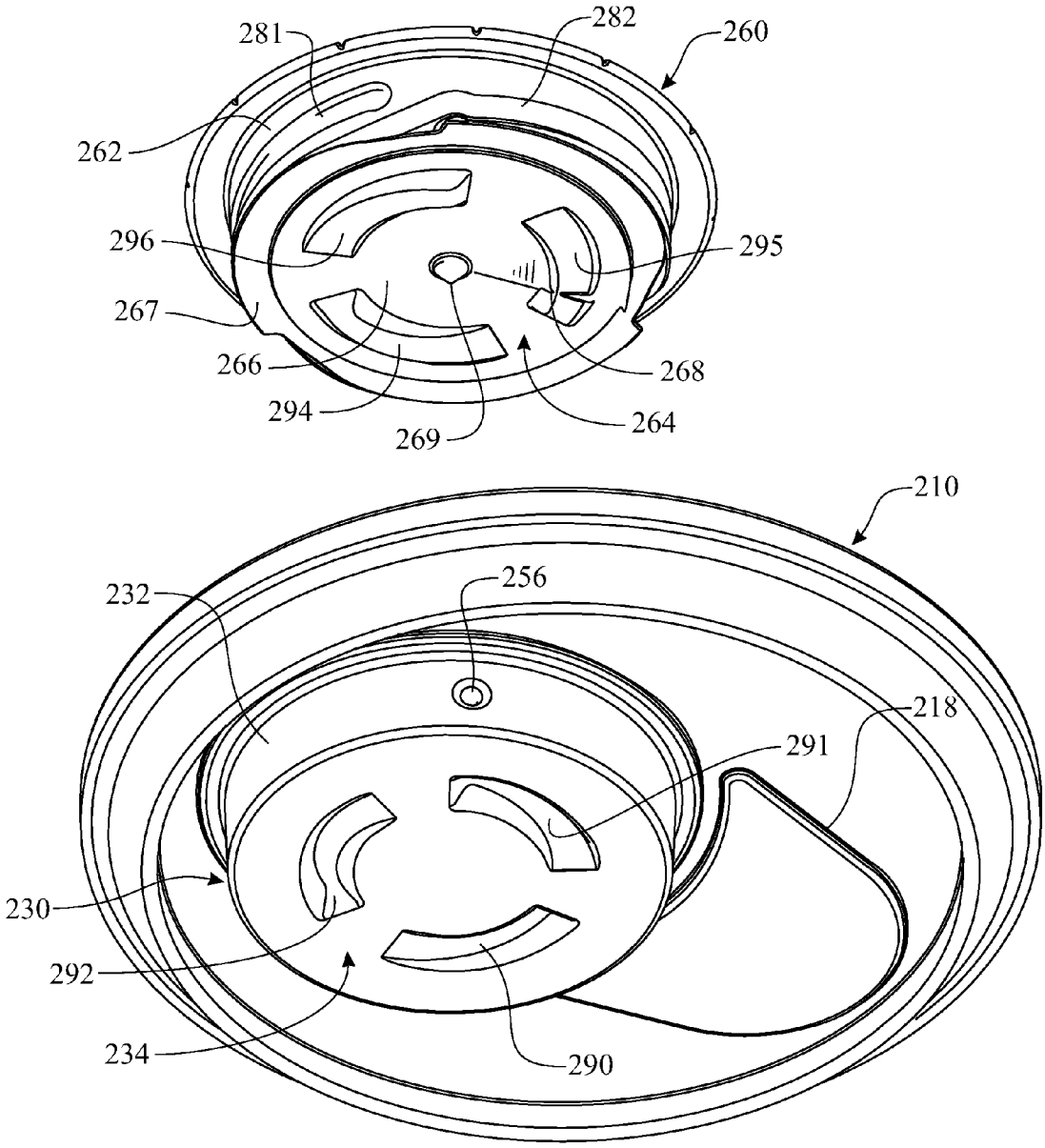
FIG. 22 presents a bottom isometric exploded assembly view of the lid and the cap of the container originally introduced in FIG. 18.
Figure 23:
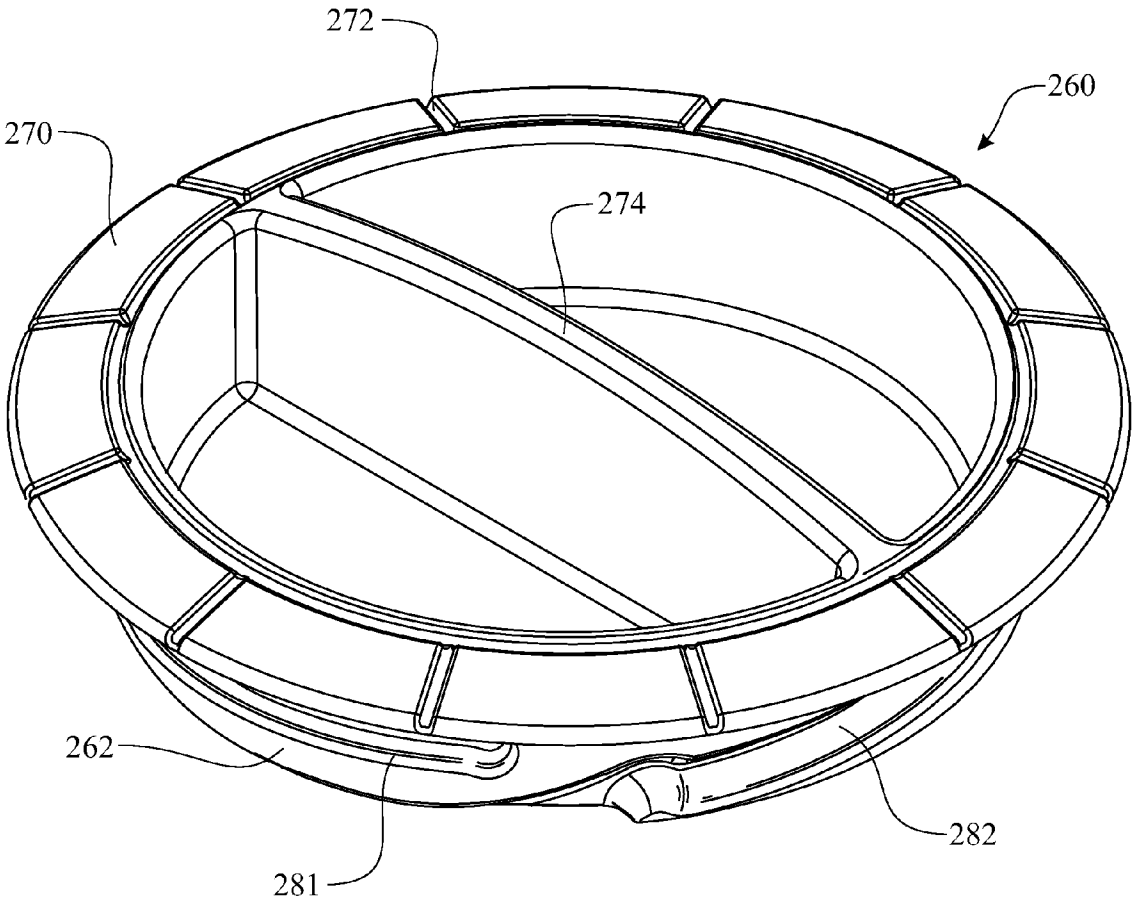
FIG. 23 presents an enlarged top isometric view of the cap of the container originally introduced in FIG. 18.
Figure 24:
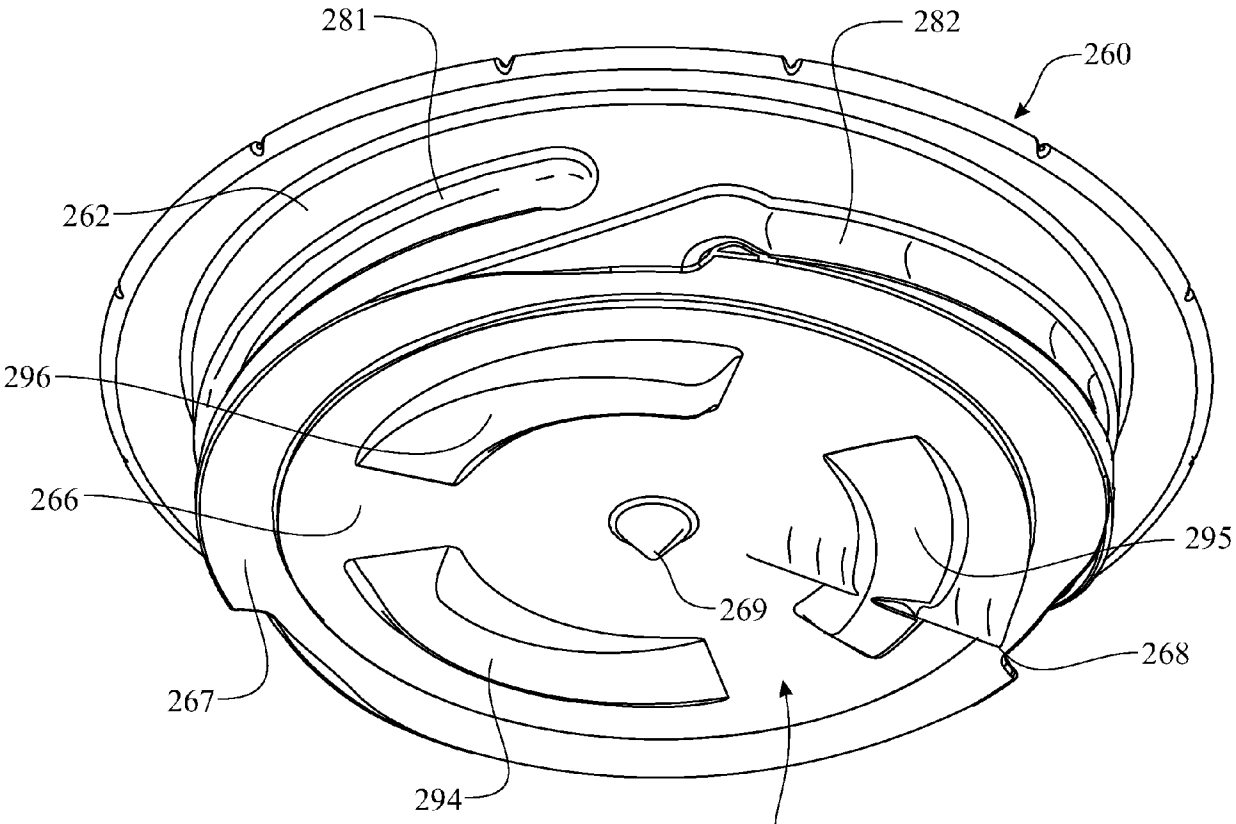
FIG. 24 presents an enlarged bottom isometric view of the cap shown in FIG. 23.

Referring to FIG. 15, a further variation of manufacturing process is disclosed. In the first step a pre-formed resealable container lid 110 is provided from a shell press with a cap receiving socket 130 already formed. In the next step, the resealable container lid 110 and cap receiving socket 130 are aligned directionally for a conversion press. Next a cap receiving socket bottom panel circular score line 136 is created in the conversion press, at the bottom of the cap receiving socket 130. Molded resealable container caps 160 are provided to the assembly line, and inserted into the molded resealable container cap 160. The molded resealable container caps 160 are secured to the cap receiving socket 130 by forming the socket sidewall cam engaging projections 150 in a manner described above, in which the resealable container cap 160 functions as a mandrel during formation of the projections. Next, the resealable container lids 110 with secured resealable container caps 160 are packaged and shipped to bottlers or others for conventional filling, sealing, and shipment to customers. As in the previously described manufacturing process, there is no need to form a rivet in the resealable container lid 110, and no need to attach a pull tab to the rivet. Avoiding these steps saves money and makes the resulting product easier to recycle.

An alternative embodiment of a container 200 is shown in FIGS. 18 through 35, and includes a body having a container cylindrical sidewall 202 and opposite axial ends. The container 100 and container 200 include a number of similar features. Like features of the container 100 and the container 200 are numbered the same except preceded by the numeral '2'. The container 200, like that of the previous embodiment (container 100), is illustrated in the size and shape of a common aluminum can used today for a wide variety of beverages, including soft drinks, juice drinks, beer, and the like. The body itself differs from the prior art in the features at the top end or lid of the container 100 where the features of the present invention allow for opening and resealing the container 200.

A container closed bottom wall 204 (seen in FIG. 20) is integrally formed at one of the axial ends with the container sidewall 202 in the known fashion of making aluminum cans. However, the body (202, 204) can be made of other materials and have other shapes, depending on either style, functionality or a combination of both. A resealable container lid 210 is attached to the open axial end of the body, at the open end defined by the container cylindrical sidewall 202, after filling the body (202, 204) with a beverage in the ordinary, and known, way of attaching resealable container lids or tops 110 to the containers 200. After assembly, the resealable container lid 210, container closed bottom wall 204 and container cylindrical sidewall 202 define a closed, interior space.

A cap receiving socket 230 is formed in the resealable container lid 210 and includes a cylindrical sidewall 110 and a cap receiving socket bottom wall 234. The cap receiving socket 230 is located eccentrically so that it nears a peripheral edge of the resealable container lid 210 to facilitate drinking and pouring after opening. The cap receiving socket 230 further includes a cap receiving socket bottom panel circular score line 236 slightly inset from the peripheral edge of the cap receiving socket bottom wall 234 and forming a cap receiving socket bottom panel substantially closed loop tear panel 238. An cap receiving socket bottom panel centered score line 242 is provided at the center of the bottom wall cap receiving socket bottom wall 234 and preferably includes two intersecting score lines that form an "X" with the intersection of the two lines being at the center of the cap receiving socket bottom wall 234. The cap receiving socket bottom wall 234 further includes socket bottom panel ramps 290, 291, 292 which are equi-distantly spaced around the periphery of the cap receiving socket bottom wall 234 inside the cap receiving socket bottom panel circular score line 236. A different number of ramps could be used, but three is preferable. The socket bottom panel ramps 290, 291, 292 are integrally formed in the cap receiving socket bottom wall 234.

The cap receiving socket 230 further includes equi-distantly spaced socket sidewall cam engaging projections 252, 254, 256 formed in the sidewall 110. From an interior view, such as that shown in FIGS. 22 and 34, the projections such as projections 124 and 128 are shown as indentations, since the projections are formed from the sidewall material. The resealable container lid 210 also includes a resealable container lid upper surface reinforcement formation 218, as in the previous embodiment, which may include instructional text to inform the consumer how to use the opening and resealing features of the container 200.

Figure 31:
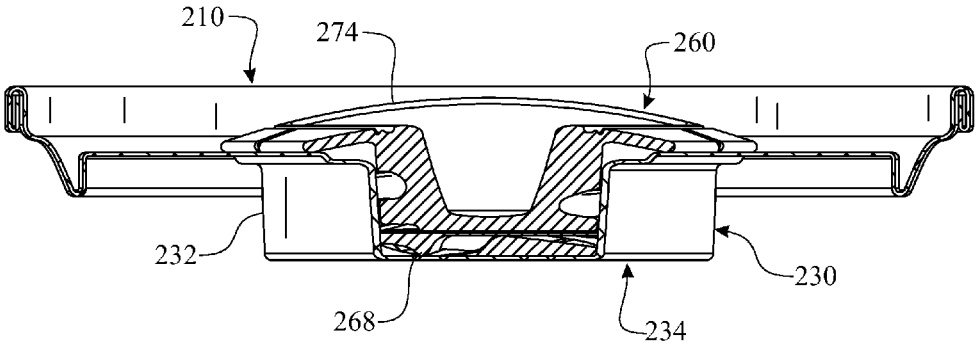
FIG. 31 presents a sectioned elevation view of the lid and cap subassembly of the container originally introduced in FIG. 18, wherein the section is taken along section line 31-31 of FIG. 25.
Figure 32:
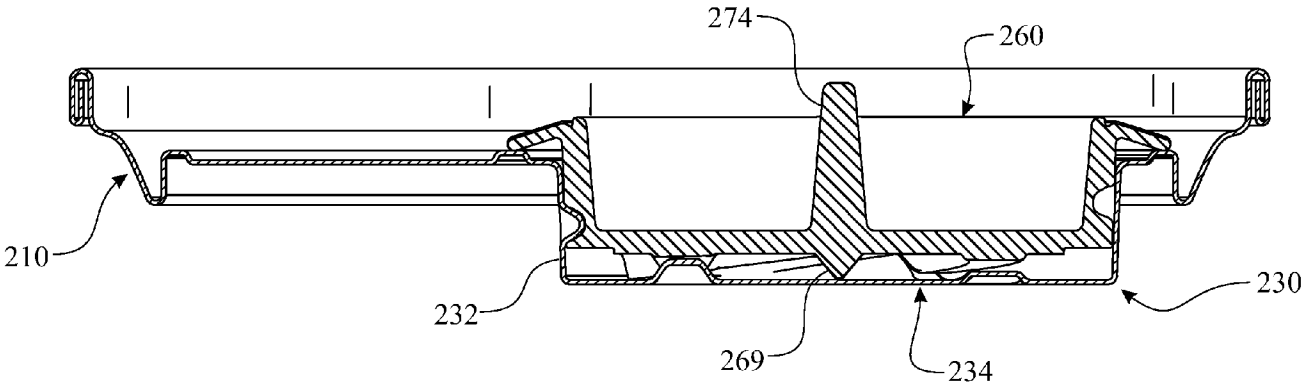
FIG. 32 presents a sectioned elevation view of the lid and cap subassembly of the container originally introduced in FIG. 18, wherein the section is taken along section line 30-30 of FIG. 25.
Figure 33:
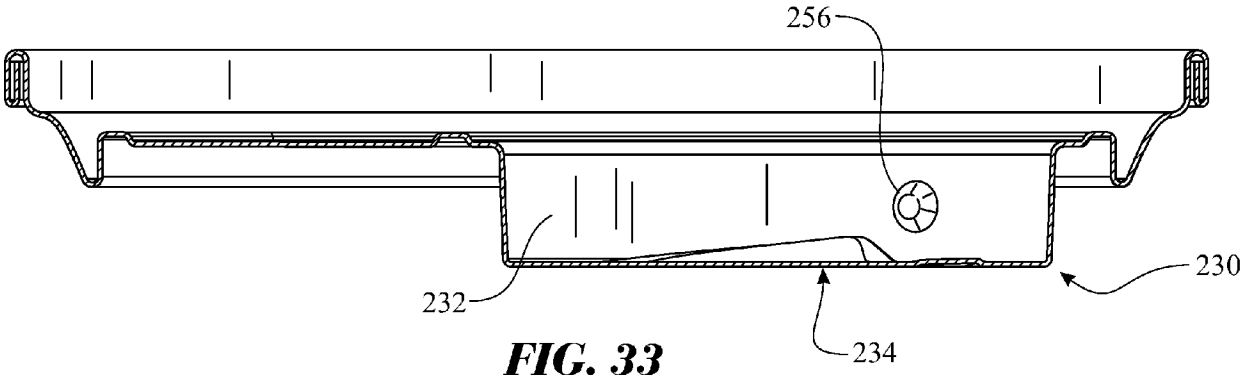
FIG. 33 presents a sectioned elevation view similar to FIG. 30, wherein the cap is excluded from illustration, exposing features of the socket within the lid of the container originally introduced in FIG. 18.
Figure 34:
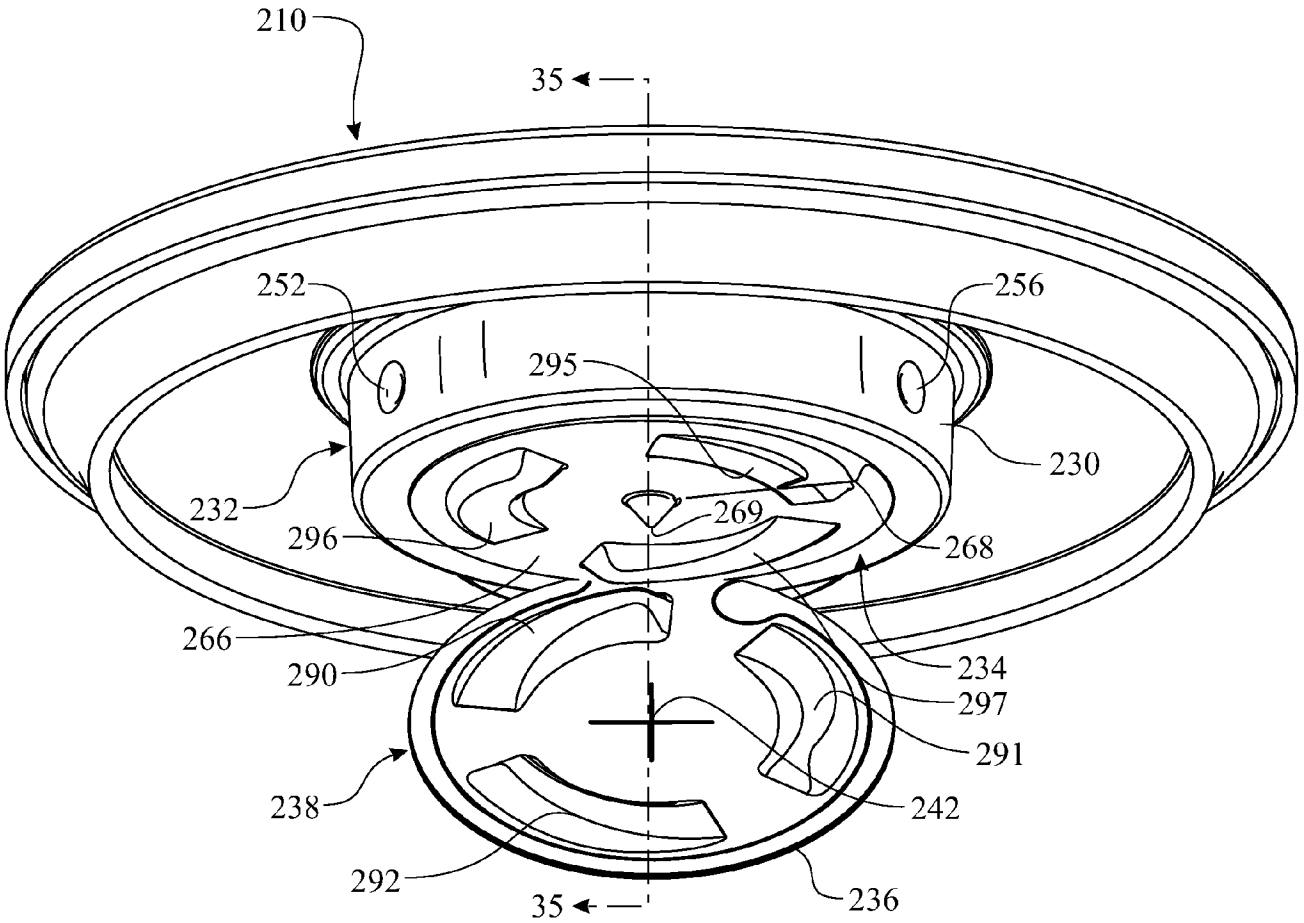
FIG. 34 presents a bottom isometric view of the lid and cap subassembly of the container originally introduced in FIG. 18, wherein the tear panel is shown after the cap has been rotated to impart linear motion fracturing the score line and bending the tear panel into the container
Figure 35:
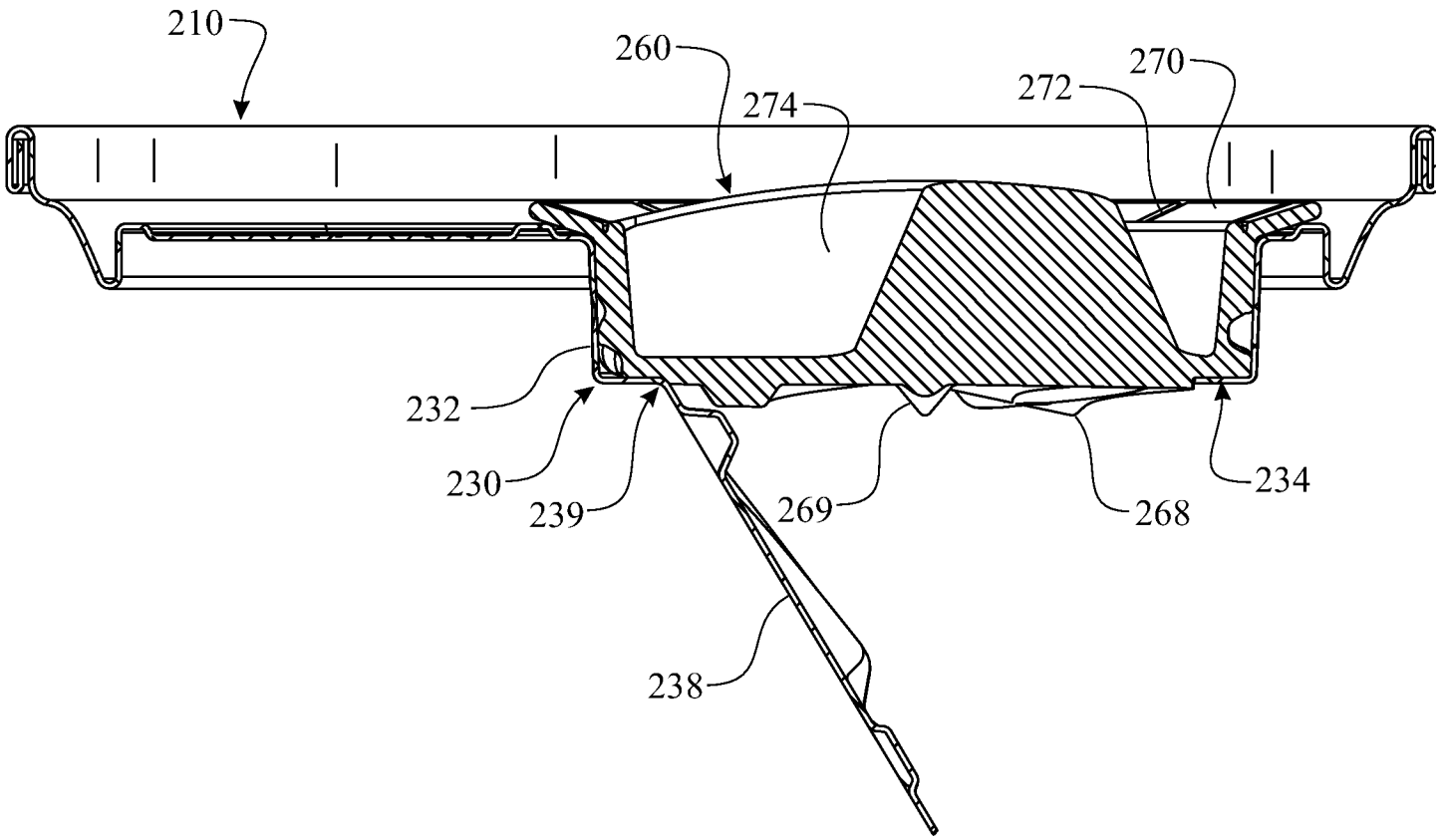
FIG. 35 presents a sectioned elevation view of the lid and cap subassembly in an opened and resealed configuration, wherein the section is taken along section line 35-35 of FIG. ##.

A resealable container cap 260 fits into the cap receiving socket 230 and includes a resealable container cap cylindrical sidewall 262 and a bottom wall 136. A series of cam groove surfaces 281, 282, 283 are provided in the resealable container cap cylindrical sidewall 262 of the resealable container cap 260 at equi-distantly spaced locations and are designed to receive the cam engaging projections 252, 254, 256, respectively, of the cap receiving socket 230, when the resealable container cap 260 is assembled within the cap receiving socket 230. In this regard, the embodiment of container 200 is similar to that of the embodiment of container 100. When assembled and before opening the container, the resealable container cap 260 seats in the cap receiving socket 230 as shown in FIGS. 30 through 32.

The resealable container cap 260 further includes a resealable container cap handle or grip element 274 at the upper end of the resealable container cap 260 so that the consumer can turn the cap in either clockwise or counterclockwise directions. As in the previous embodiments, the upper perimeter of the resealable container cap 260 is provided with a radially extending cap skirt 270 which provides a tamper resistant feature, whereby the skirt would extend upwardly if the cap had been turned to cause the resealable container cap 260 to descend further into the cap receiving socket 230. The radially extending cap skirt 270, and all other features of the resealable container cap 260 are integrally formed in a one-piece construction preferably of a plastic material, Within the scope of the invention, other materials could be used including ceramic and metallic materials.

A sharp centered incising projection 269 is formed in the center of the bottom surface of the resealable container cap 260, so that when the resealable container cap 260 is fitted in the cap receiving socket 230, prior to opening the beverage can 100, the point of the sharp centered incising projection 269 is positioned next to or juxtaposed at the center of the bottom surface of the cap receiving socket 230, at the point of intersection between the two lines that form the cap receiving socket bottom panel centered score line 242. The sharp centered incising projection 269 punctures the cap receiving socket bottom wall 234 of the cap receiving socket 230 as the resealable container cap 260 moves linearly downwardly and further into the cap receiving socket 230 during opening operation of the beverage can 200.

Figure 30:
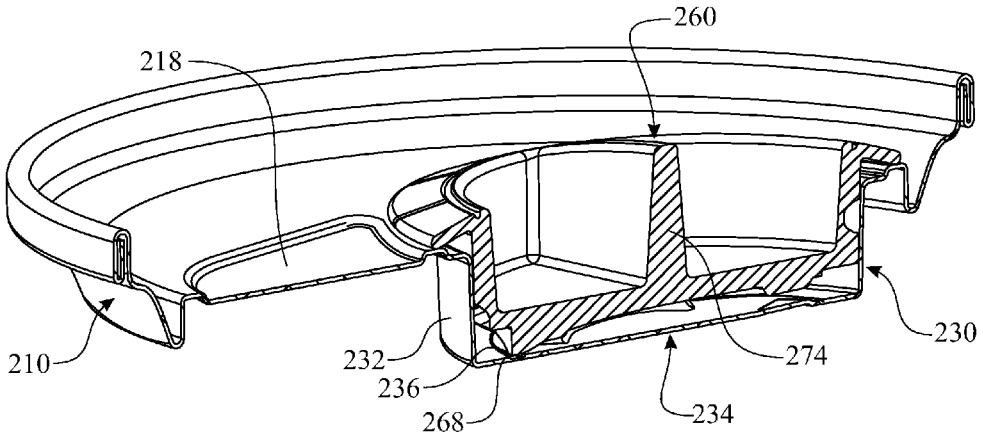
FIG. 30 presents an isometric, sectioned view of the lid and cap subassembly of the container originally introduced in FIG. 18, wherein the section is taken along section line 30-30 of FIG. 25.

An offset projecting incisor 268 is formed along an outer region of the bottom surface of the resealable container cap 260, so that when the resealable container cap 260 is fitted in the cap receiving socket 230, prior to opening the beverage can 100, the point of the sharp offset projecting incisor 268 is positioned in alignment with the cap receiving socket bottom panel circular score line 236 formed in the bottom surface of the cap receiving socket 230, as best shown in FIG. 30. The sharp offset projecting incisor 268 fractures the cap receiving socket bottom panel circular score line 236 formed in the cap receiving socket bottom wall 234 of the cap receiving socket 230 as the resealable container cap 260 moves linearly downwardly and further into the cap receiving socket 230 during opening operation of the beverage can 100.

Figure 25:
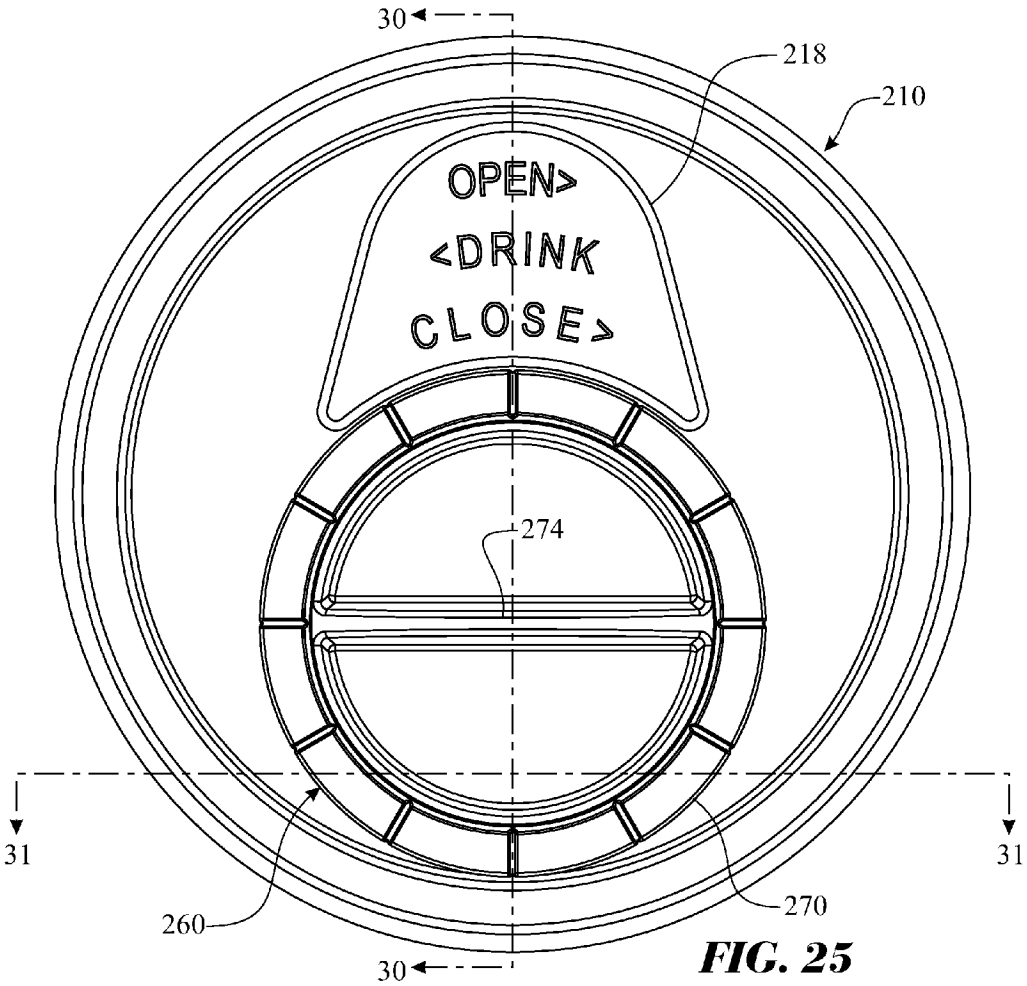
FIG. 25 presents a top plan view of the lid and the cap of the container originally introduced in FIG. 18, wherein the lid and cap are shown assembled to one another.
Figure 26:
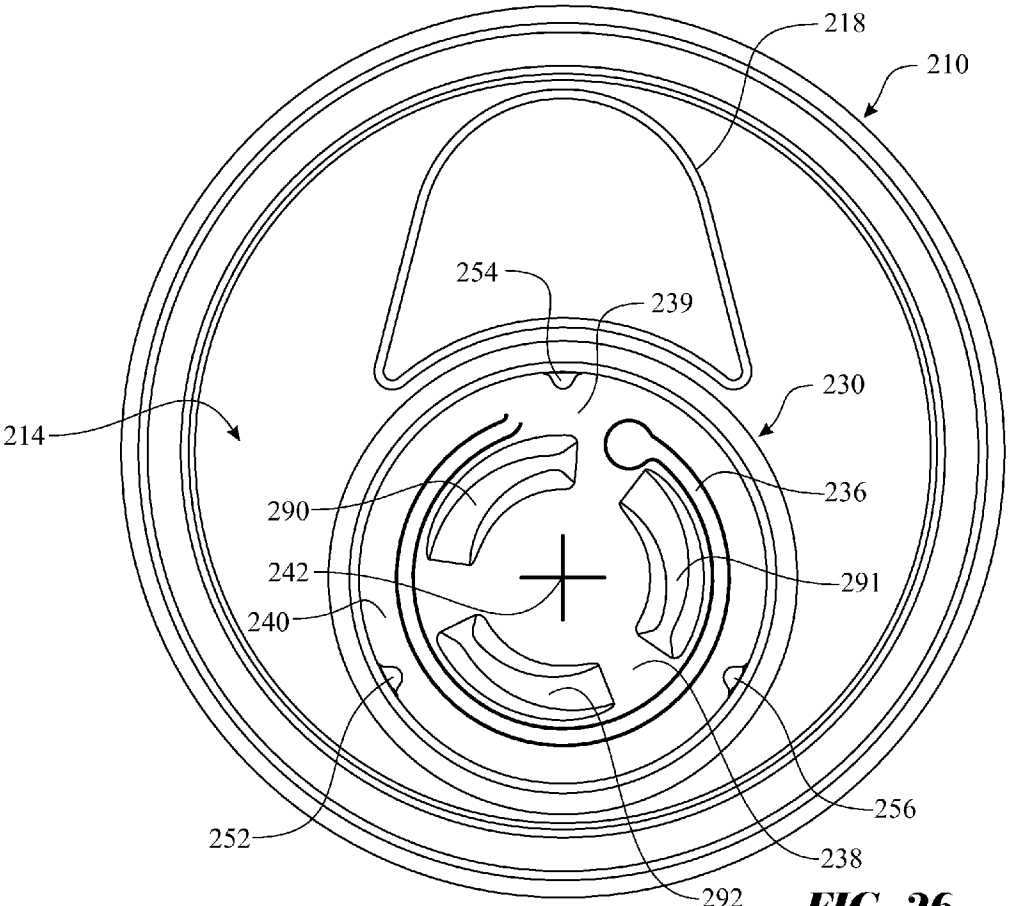
FIG. 26 presents a top plan view of the lid of FIG. 25, wherein the illustration excludes the cap to expose details of the socket.
Figure 27:
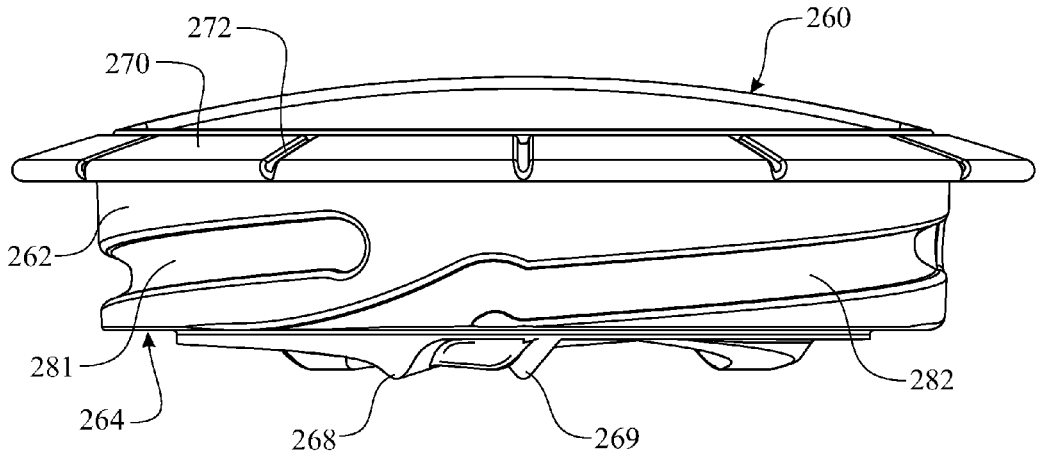
FIG. 27 presents a side elevation view of the cap of the container originally introduced in FIG. 18.
Figure 28:
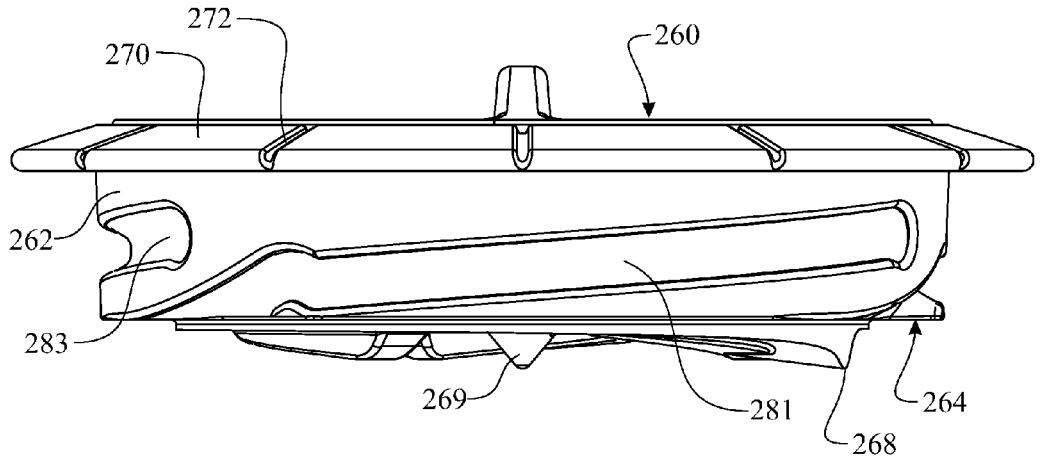
FIG. 28 presents a side elevation view of the cap of FIG. 27, wherein the cap is rotated ninety degrees (90°) from the view illustrated in FIG. 27.
Figure 29:
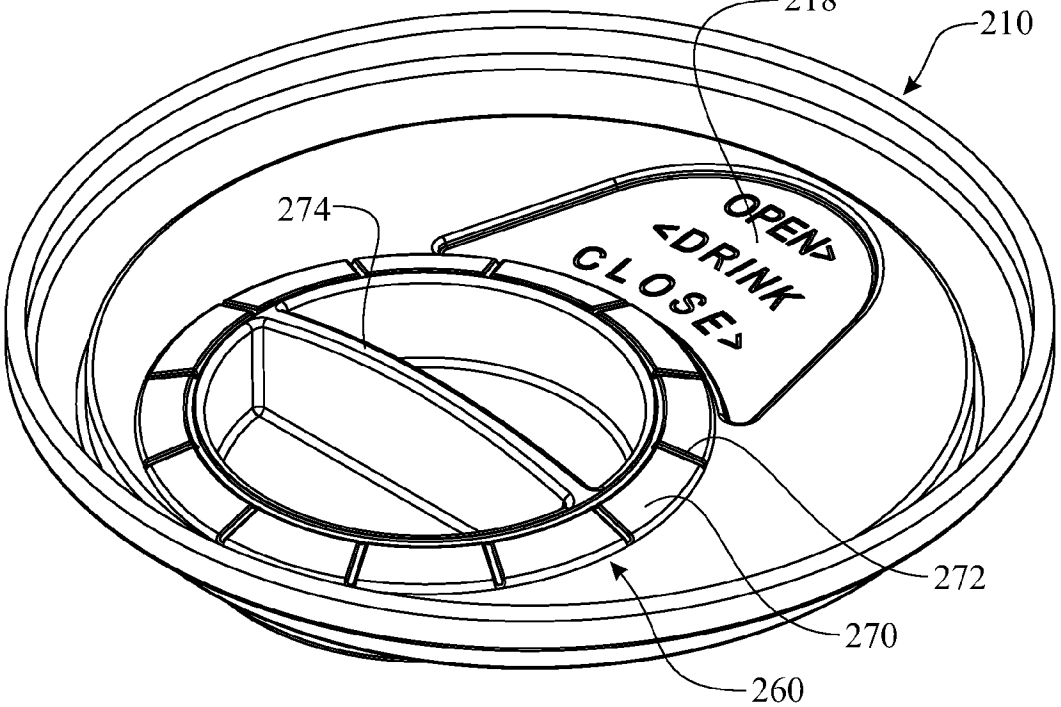
FIG. 29 presents a top isometric view of the cap and the lid of the container originally introduced in FIG. 18, wherein the cap and the lid are shown as a subassembly.

To understand how the embodiment of container 200 operates, reference is made to FIG. 25, which is a top view of the beverage container prior to opening. Optionally, the resealable container lid upper surface reinforcement formation 218 is embossed, printed or otherwise marked with instructions for how to use the resealable container cap 260. First, the consumer is instructed to open the beverage container by turning, or rotating, the resealable container cap 260 in the clockwise direction. The degree of slope on the ramps and the degree of slope on the spiral grooves is selected to ensure that the container 200 can be opened with the same or similar amount of force used to open a conventional beverage container, such as a soda can. This can be accomplished with a turning motion of the cap that is in the range of 45 to ninety degrees)(45-90°, preferably.

After the resealable container cap 260 is rotated or turned to the full extent allowed, the resealable container cap 260 pushes the cap receiving socket bottom panel loop tear panel 238 into the can, but the tear panel 238 stays connected to the resealable container lid 210 through a portion of the lid between the ends of the cap receiving socket bottom panel circular score line 236. In order to then drink the contents of the container 200, the consumer turns, twists or rotates the resealable container cap 260 in the opposite direction until returning past the starting point from where the opening rotation started, placing the cam engaging projections 252, 254, 256 in the opened area of the cam groove surfaces 281, 282, 283.

At that point, the resealable container cap 260 is pulled upwardly by the consumer to become separated from the container 200, and the consumer is then free to drink from the opening formed in the resealable container lid 210 as a result of the cap receiving socket bottom panel substantially closed loop tear panel 238 being pushed into the container 100. When the consumer is finished drinking, and if the container 200 is not empty, the consumer can reseal or close the beverage container by pushing the resealable container cap 260 back into the cap receiving socket 230 and then turning, twisting or rotating the resealable container cap 260 in the same direction as the opening direction, until the resealable container cap 260 is fully seated in the cap receiving socket 230, thus sealing the opening in the container 200. In the resealed state, the contents of the container 200 can be kept fresh, carbonated (in the case of carbonated drinks), and spill-proof (when the beverage container 200 is mobile, such as if kept in a back pack, stroller, automobile drink holder, and the like).

As in the other embodiments described herein, the invention includes an assembled container 200, with or without contents, with a unique resealing mechanism. The invention also includes a container subassembly comprising a resealable container lid 210 and a resealable container cap 260, capable of further assembly with a container body 202, 204, such as beverage containers commonly in use as aluminum cans for distribution of a wide variety of beverages. The invention further includes a resealable container cap 260 capable of use with a resealable container lid 210, or with a container 200 that includes a resealable container lid 210, such that the beverage containers could be purchased without resealable container caps 260, and could separately purchase resealable container caps 260 that are then used with the containers 200 that are formed with the aforementioned cap receiving socket 230. This way, resealable container caps 260 could be re-used, repeatedly. Purchase of resealable container caps 260 separately from the containers 200 would have a "green" effect, in that the resealable container caps 260 could be washed and re-used over and over, thereby reducing waste.

Figure 36:
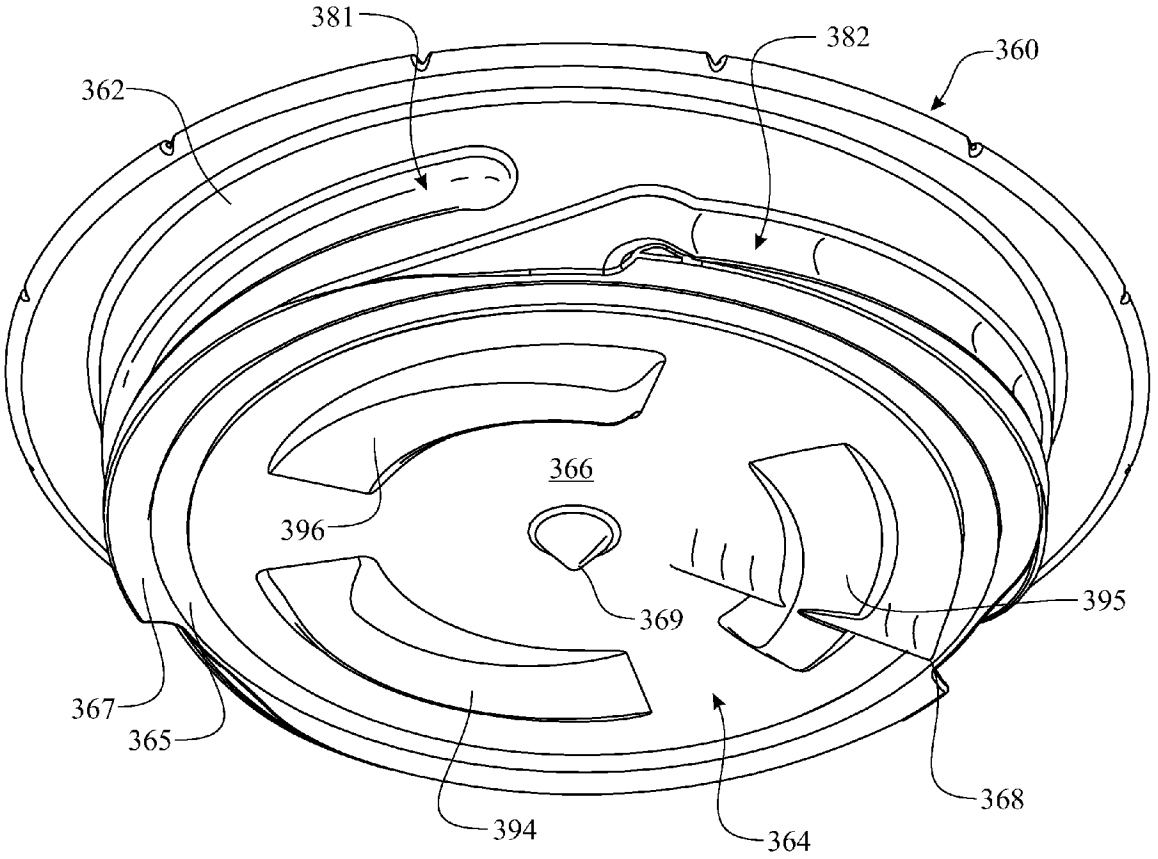
FIG. 36 presents a bottom isometric view of an enhanced cap, wherein the enhanced cap is similar in all aspects to the previously illustrated caps, while introducing a soft plastic sealing ring to further enhance the sealing capabilities of the cap.
Figure 37:
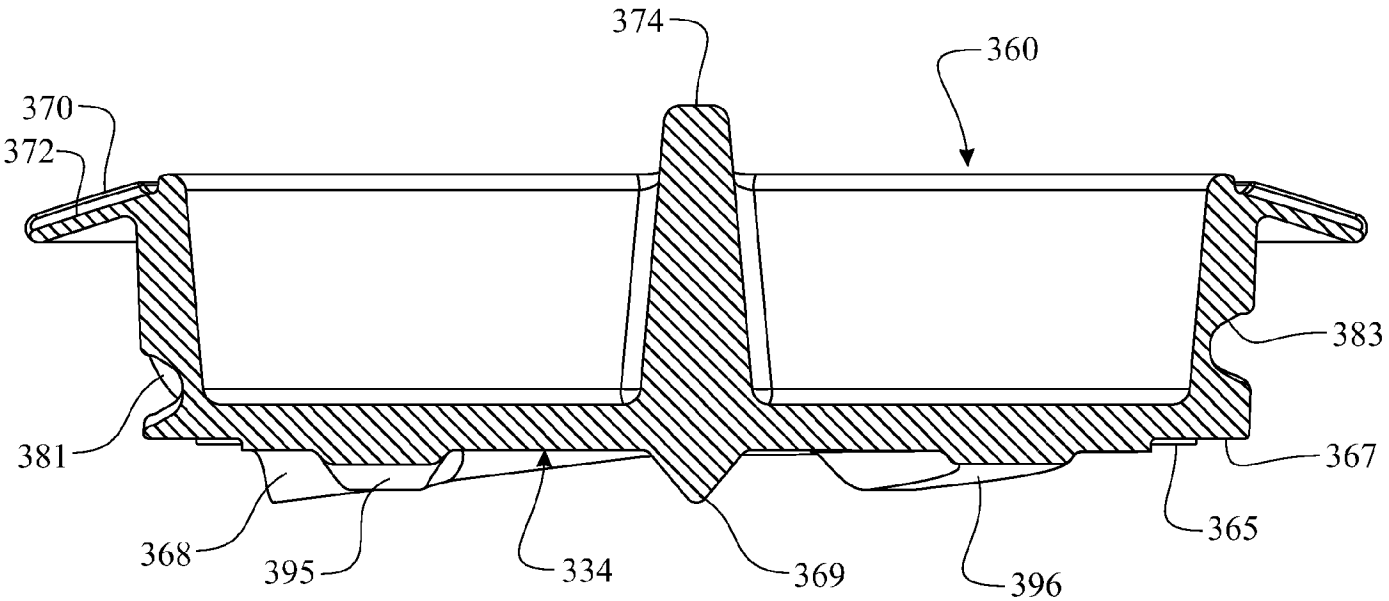
FIG. 37 presents a cross sectioned elevation view of the cap originally introduced in FIG. 36.

Another feature of the invention is to provide a resealable container cap 360, as illustrated in FIGS. 36 and 37. The resealable container cap 260 and resealable container cap 360 include a number of similar features. Like features of the resealable container cap 260 and the resealable container cap 360 are numbered the same except preceded by the numeral '3'. The resealable container cap 360 includes the features presented above, including the cap bottom surface ramps 394, 395, and 396, and cam groove surfaces 381, 382, and 383. As with the other embodiments, the resealable container cap 360 has an cap receiving socket bottom wall 334 from which the ramps project. A cap sealing ring 365 is provided on the surface of the cap receiving socket bottom wall 334 near the periphery thereof. The cap sealing ring 365 is made of an elastomeric material that is different from the material that constitutes the resealable container cap 360, which is preferably made of a hard plastic material. The material which forms the cap sealing ring 365 can be injected through ports into a mold and formed on the resealable container cap 360 at the same time that the resealable container cap 360 is being injection molded. Alternatively, the cap sealing ring 365 can be a separate pre-formed item that can be adhesively bonded in place after the resealable container cap 360 is removed from its mold.

A central sharp projection 241 is formed in the center of the bottom surface of the resealable container cap 360, wherein the central sharp projection 241 is similar to the sharp centered incising projection 269 described above in design, location and function.

An offset projecting incisor 368 is formed along an outer region of the bottom surface of the resealable container cap 360, wherein the offset projecting incisor 368 is similar to the offset projecting incisor 268 described above in design, location, and function.

Any of a variety of thermoplastic elastomers (TPEs) can be used to make the cap sealing ring 365, and selection of the precise one is a matter of design choice, as the requirements are simply that the material be easy to mold, easily adherent to the material that makes up the cap, and to some degree deformable under pressure (in use). Other materials could be used if a sealing ring is pre-made and adhesively bonded to the end face or bottom wall of the cap. However, molding the ring in place is preferred. As for TPEs, they are sometimes referred to as thermoplastic rubbers, and are in a class of copolymers or a mixture of polymers which consist of both thermoplastic and elastomeric properties. They are particularly suitable for injection molding, which is the preferred way to form the cap sealing ring 365 on the face of the resealable container cap 360.

Figure 38:
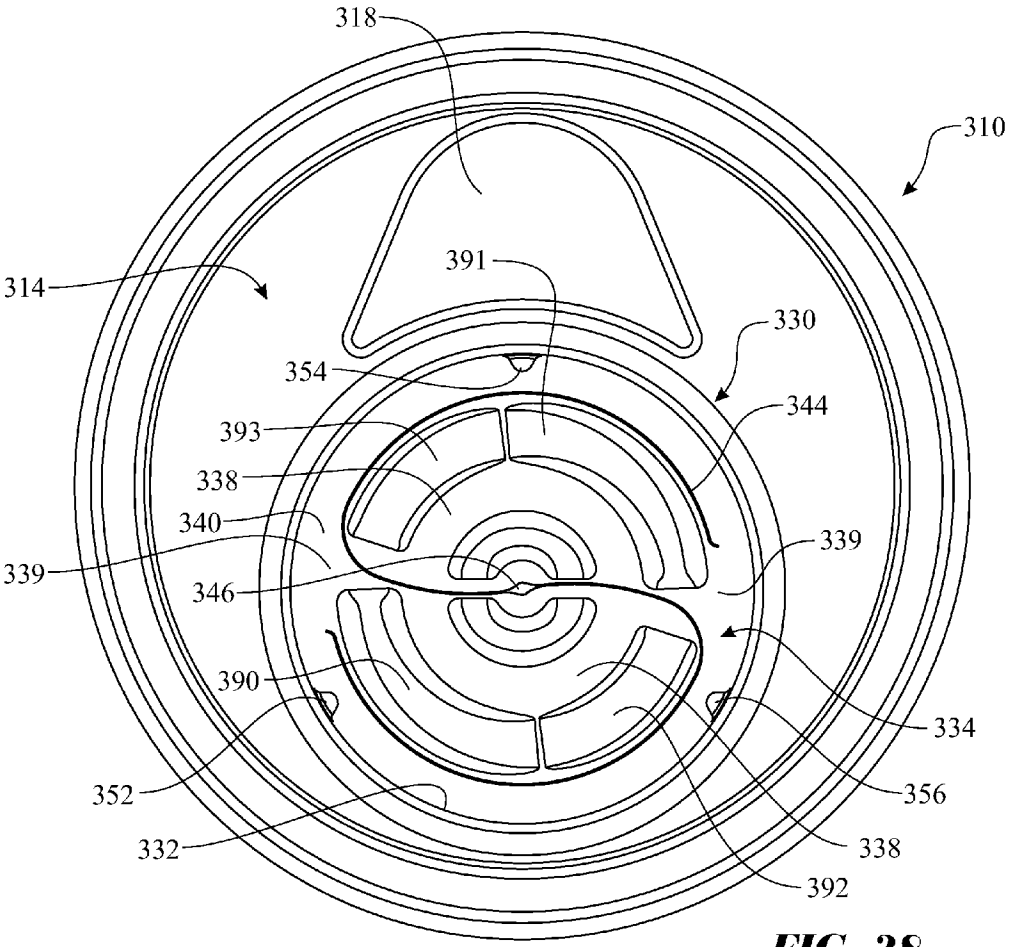
FIG. 38 presents a top plan view of another exemplary container lid, wherein the container lid is similar in all aspects to the previously illustrated lids, while introducing an alternative score line, wherein the alternative score line defines two tear panels for use during the opening process.

It is noted that in FIG. 38, there are two ramps 390, 391 illustrated as opposed to three, which are found in the other embodiments. Essentially any number of ramps can be employed, but two or three are more preferred for reasons that two or three can generate an opening force without requiring too much torque, and they are easier to manufacture than a number greater than three. As seen in FIG. 38, a cap used in the embodiment of FIG. 38 has two ramps on the lower end face that are shaped and positioned compatibly with the socket bottom panel ramps 390 and 391 shown in FIG. 38.

The resealable container cap 360 operates in the same way as the caps of previous embodiments, in that the consumer turns the cap in one direction to open the container, then turns the resealable container cap 360 in the opposite direction to remove the resealable container cap 360, and then the resealable container cap 360 is re-inserted into the cap receiving socket 230 and turned in the first, container-opening direction until the resealable container cap 360 is fully seated in the cap receiving socket 230. The resealable container cap 260 is shown in this fully seated position in FIG. 35, for resealing the container 200, in which the bottom surface 264 of the resealable container cap 260 presses against the cap receiving socket bottom wall 234 of the cap receiving socket 230 to form a sealing engagement between the cap receiving socket 230 and the cap. With the embodiment of resealable container cap 360 that includes the sealing ring 367, in this position, the cap sealing ring 365 is pressed against the cap receiving socket bottom wall 234 of the cap receiving socket 230 to enhance the sealing relationship between the cap receiving socket 230 and the resealable container cap 360. Contact between a hard surface, i.e., the metal material that makes up the cap receiving socket 230, and a relatively softer material, i.e., the elastomeric material that makes up the cap sealing ring 365, will ensure a better seal for the contents of the container 200. This is particularly useful when it comes to carbonated beverages, such as sodas, beers, and the like.

Figure 39:
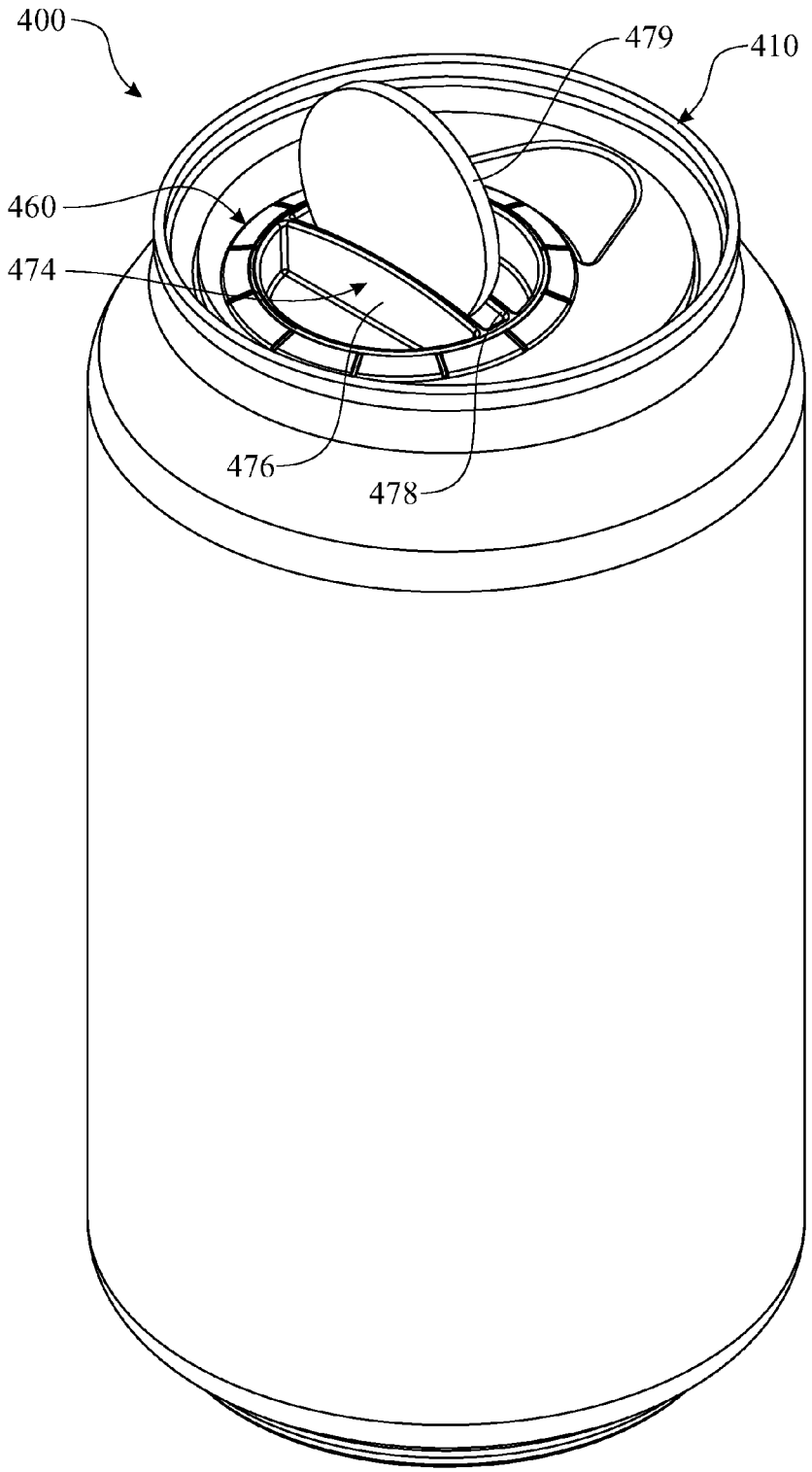
FIG. 39 presents a top and side isometric view of another exemplary container, wherein the cap introduces a grip capable of using an implement, such as a coin and the like, enabling the consumer to impart a greater opening force thereto.
Figure 40:
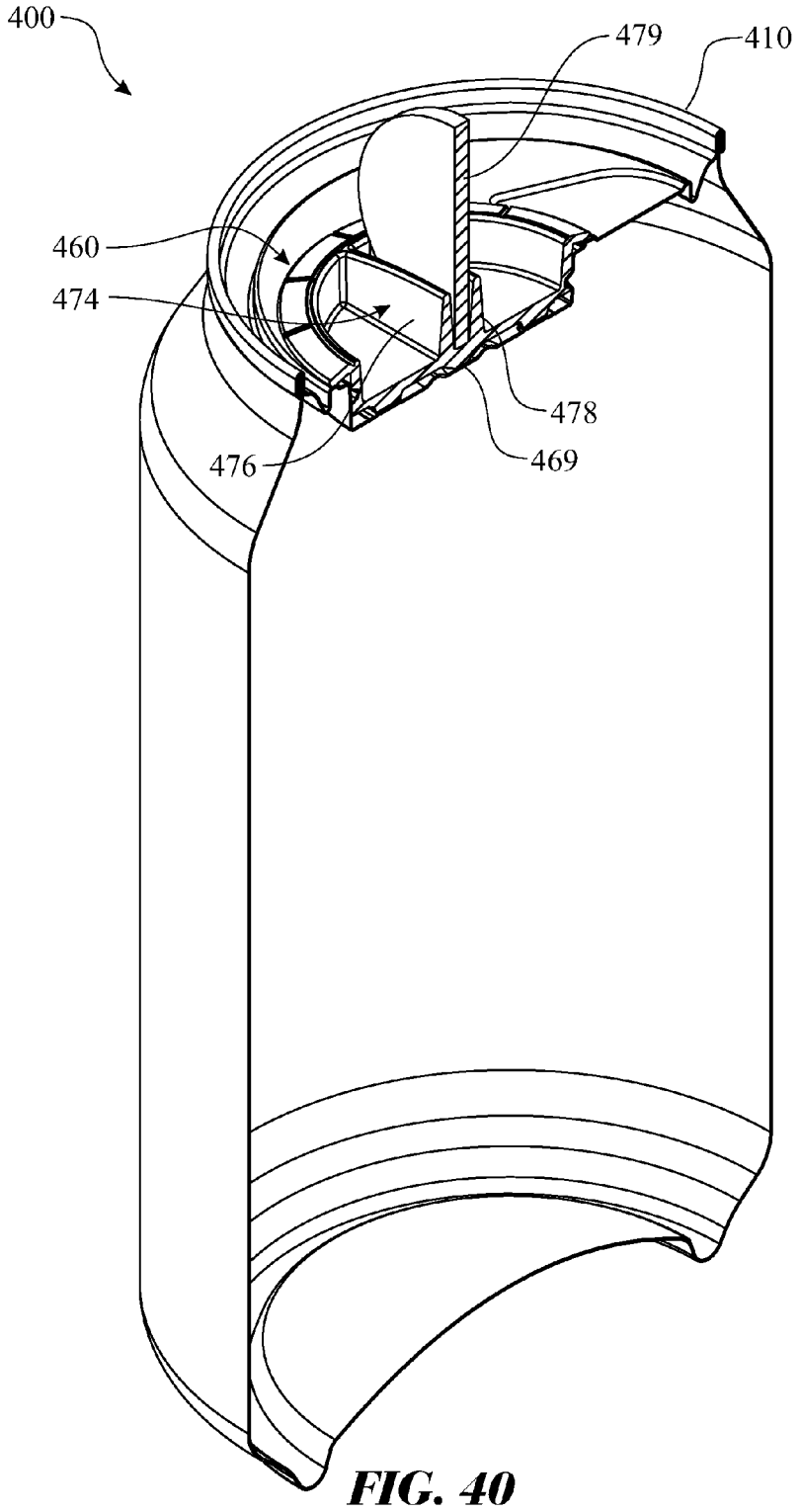
FIG. 40 presents a sectioned top and side isometric view, wherein the illustration demonstrates the use of a coin or other implement in conjunction with a grip to impart a greater opening force by the consumer.

In the previously described embodiments, the cap is provided with a resealable container cap handle or grip element 174, as seen in FIGS. 10, 11 and 13*a*, for example. An alternative embodiment of a resealable container cap grip element 374 is shown in FIGS. 39 and 40, in which the resealable container cap grip element 474 includes two parallel resealable container cap grip element first cross member 476 and 478, spaced apart by an amount sufficient to fit a force enhancing, or grip enhancing implement 479, such as a coin or other object made of a material that is rigid and strong enough to transfer torque from the consumer's hand to the resealable container cap 460. It is understood that the larger the diameter of the coin or other object, the greater the force that can be transmitted to the resealable container cap 460. The container 300 can be sold as an assembly which includes the resealable container cap 460 and the implement (coin) 479 (assuming it is not a coin), a subassembly including the resealable container lid 410, resealable container cap 460 and grip enhancing implement 479 (without the container body and sealed contents), or the resealable container cap 460 can be sold by itself. For ease of storage and transportation, and as a cost saving, it is preferable not to sell or package an grip enhancing implement 479 with the container 400 or resealable container cap 460, and/or lid/cap assembly.

Figure 41:
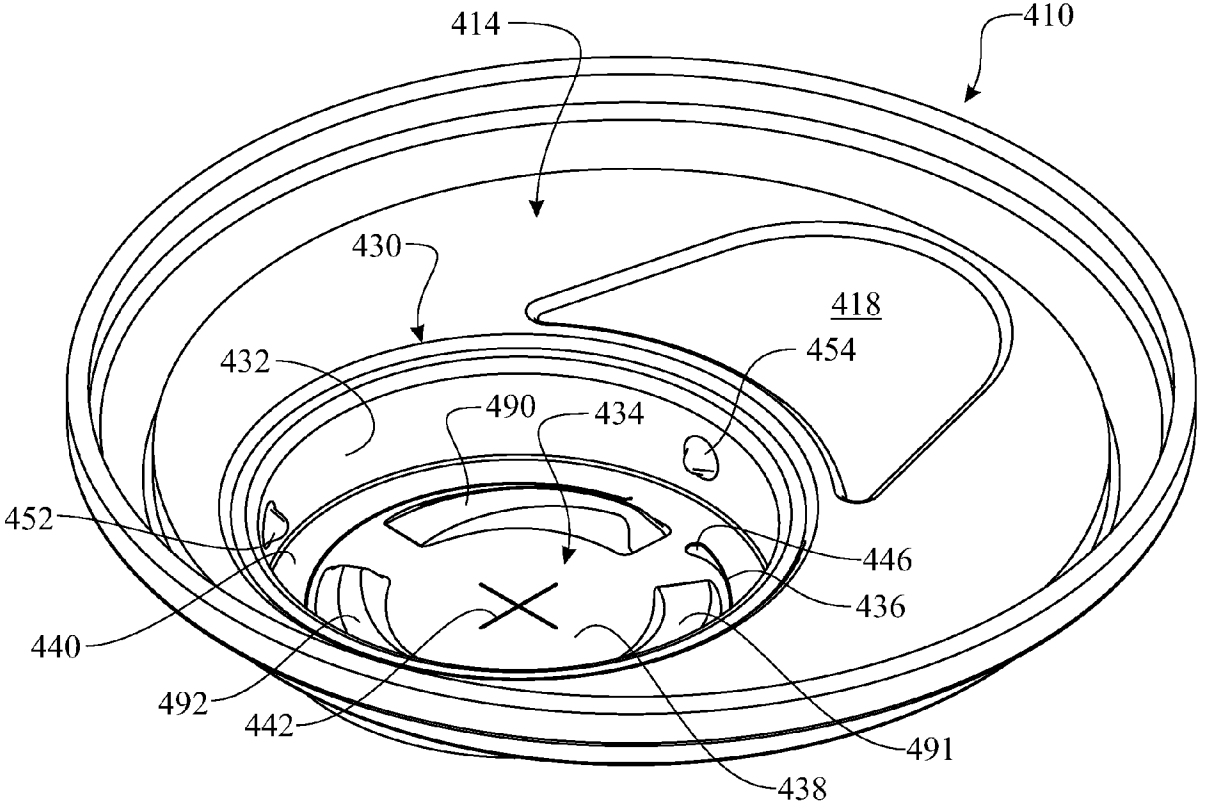
FIG. 41 presents a top isometric view of another enhanced container lid, wherein the enhancement introduces an accelerant for initiating a fracture of the score line.

Referring now to FIG. 41, another aspect of the invention includes making the score line which defines the tear panel or panels in a way that enhances the opening or fracturing ability of the score line. As seen in FIG. 41, a resealable container lid 410 includes a cap receiving socket bottom wall 434 which includes a cap receiving socket bottom wall 434. The cap receiving socket bottom wall 434 includes three socket bottom panel ramps 490, 491 and 492, and a cap receiving socket bottom panel tear panel 438 defined by a cap receiving socket bottom panel circular score line 436. The cap receiving socket bottom panel circular score line 436, as in one of the previous embodiments, is in the form of a loop, not quite fully disposed, so that a hinge is defined between the opposite ends of the cap receiving socket bottom panel circular score line 436. The cap receiving socket bottom panel circular score line 436 is made during the formation steps that create the resealable container lid 410, which in the case of beverage cans, is made of 0.008 inch thick material. The score line 436 is typically 0.004 inch deep, so that the thickness of the lid 410 under the score line 436 is typically about 0.004 inch thick for aluminum beverage cans. The thinning of the material occurs during pressing of the lid 410, and in essence, the material which comprises the lid 410 is deformed and flows to create a thinned area beneath the score line 436.

Using the same principals of material flow or deformation during the pressing steps, a score line thinned fracture initiation region 437 is formed at one end of the cap receiving socket bottom panel circular score line 436 where one of the ramps 394, 395, 396 in conjunction with ramps 490, 491, 492 will impinge upon the score line 436. At the beginning of the opening process, the ramps 394, 395, 396 in conjunction with ramps 490, 491, 492 push on the flared, score line thinned fracture initiation region 437, which has been thinned essentially to the thickness of the sidewall 102, 202 of the container 100, 200, in the case of an aluminum can. In other words, the entire area of the puncture area is thinned relative to the surrounding surface of the lid 410 to make it easier to puncture or break the score line 436. Once the score line 436 is broken at the puncture area 437, the break will propagate more readily and predictably around the score line 436 to ease the opening of the container 100, 200. Although the score line thinned fracture initiation region 437 is thinner, and thus potentially more vulnerable to accidental opening, it is no thinner than the sidewall of the beverage container and thus capable of withstanding internal pressures. It is also shielded from accidental external rupture by means of the cap 460 when seated in the socket 430.

Each embodiment described herein has referred to a tear panel, such as cap receiving socket bottom panel tear panel 138, as that part of the bottom wall of the socket that is defined by a circular or loop-shaped score line. This tear panel can also be described as a "frangible area" because it breaks away from the rest of the bottom wall 138, 238, 338, 438 when the cap 160, 260, 360, 460 descends into the socket 130, 230, 330, 430. It is not required, however, for the tear panel 138, 238, 338, 438 or frangible area to be substantially circular or looped in shape, and indeed, a second illustrated embodiment is shown in FIG. 38. While all other aspects of the resealable container lid 310 are the same as in previous embodiments, including a cap receiving socket 330 having a cap receiving socket bottom wall 334, the bottom wall 334 is provided with an cap receiving socket bottom panel "S" shaped score line 344 which, when fractured by operation of the down movement of the cap and engagement of socket bottom panel ramp 390 and 391, the fracture forms two separate tear panels 338 which are pushed inwardly during the opening operation, with the two tear panels 338 being connected to the can by a hinge area 339 on opposite sides of the cap receiving socket bottom wall 334. During the opening process, the sharp protrusion in the middle of the bottom wall of the cap will puncture the center of the score line 344 at a score line fracture thinned initiation region 346. At about the same time, the ramps 390, 391, 392, 393 of the cap receiving socket 330 and the ramps 394, 395, 396 of the resealable container cap 360 cooperate to push the tear panels 338 at locations opposite what will become the hinges 339, in essentially the "loop" portions of the cap receiving socket bottom panel "S" shaped score line 344. Simultaneously, two tear panels 338 are formed and pushed into the interior of the container 100, 200.

During opening and closing operations, the resealable container cap handle or grip element 274, 474 is turned preferably ninety degrees (90°) in one direction, and then to withdraw the resealable container cap 260, 360, 460 from the socket, the grip 274, 474 is turned ninety degrees (90°) in the opposite direction, to the beginning point. In order to remove the resealable container cap 260, 360, 460 altogether from the lid, the grip is turned approximately another ten degrees (10°) until the grooves and protrusions are separated and the resealable container cap 260, 360, 460 is free to be lifted upwardly away from the container. Different combinations of embossed ramps 390, 392 and de-bossed ramps 391, 393, and different numbers of ramps, can be employed to achieve the desired effect. The space between the resealable container cap 260, 360, 460 and the cap receiving socket bottom wall 234, 334 of the cap receiving socket 230, 330, 430 is equal to the length of linear travel when the resealable container cap 260, 360, 460 is operated between the transport and open/resealed positions (in the case of aluminum beverage cans, approximately 0.055 inches). With the use of ramps that are embossed on the tear panel 238, 338, 438 that distance can be doubled, forcing the tear panel 238, 338, 438 to fold on its hinge 239, 339, 439 further away from the opening.

In all cases using ramps, it is preferred that the peak height of the ramps be disposed near or in close proximity to the hinge, as this will help push the tear panel 238, 338, 438 out of the way when the cap's cam body pushes through the opening. The ramps help propagate the ruptured score line along its length. There are corresponding ramps or other structures on the bottom of the cap that will interface with ramps on the tear panel 238, 338, 438 or panels. All ramps are embossed (rise up from the bottom socket surface), but they could equally be de-bossed ramps 391, 393 that start below the bottom socket surface and continue up the embossed ramp 390, 392. If the respective ramp on the cap starts inside the debossed ramp on the lid 210, 310, 410, during operation the effective linear travel of the cap 260, 360 460 can be doubled, tripled, and perhaps quadrupled.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

REFERENCE ELEMENT DESCRIPTIONS

Ref. No. Description

100 container
102 container cylindrical sidewall
104 container closed bottom wall
110 resealable container lid
114 resealable container lid upper surface
118 resealable container lid upper surface reinforcement formation
119 resealable container lid planar upper surface outer segment
130 cap receiving socket
132 cap receiving socket cylindrical sidewall
134 cap receiving socket bottom wall
136 cap receiving socket bottom panel circular score line
138 cap receiving socket bottom panel tear panel
139 tear panel hinge
140 cap receiving socket bottom panel flat annular surface
142 cap receiving socket bottom panel centered "X" shaped score line
150 socket sidewall cam engaging projections
160 resealable container cap
162 resealable container cap cylindrical sidewall
164 resealable container cap bottom surface
166 cam shaped cap bottom surface
167 flat annular cap bottom sealing surface
168 offset projecting incisor
169 centered projecting incisor
170 radially extending cap skirt
172 radially extending cap skirt frangible score lines
174 resealable container cap grip element
180 cam groove surface
181 first cam groove surface
182 second cam groove surface
183 third cam groove surface
184 sloped cam groove surface segment
186 embossed cam surface lower detent
188 embossed cam surface upper detent
200 container
202 container cylindrical sidewall
204 container closed bottom wall
210 resealable container lid
218 resealable container lid upper surface reinforcement formation
230 cap receiving socket
232 cap receiving socket cylindrical sidewall
234 cap receiving socket bottom wall

236 cap receiving socket bottom panel circular score line
238 cap receiving socket bottom panel substantially closed loop tear panel
239 tear panel hinge
242 cap receiving socket bottom panel centered score line
252 first socket sidewall cam engaging projection
254 second socket sidewall cam engaging projection
256 third socket sidewall cam engaging projection
260 resealable container cap
262 resealable container cap cylindrical sidewall
264 resealable container cap bottom surface
266 cam shaped cap bottom surface
267 flat annular cap bottom sealing surface
268 offset projecting incisor
269 centered incising projection
270 radially extending cap skirt
272 radially extending cap skirt frangible score lines
274 resealable container cap grip element
281 first embossed cam surface
282 second embossed cam surface
283 third embossed cam surface
290 first socket bottom panel ramp
291 second socket bottom panel ramp
292 third socket bottom panel ramp
294 first cap bottom surface projecting feature (ramp)
295 second cap bottom surface projecting feature (ramp)
296 third cap bottom surface projecting feature (ramp)
310 resealable container lid
314 resealable container lid upper surface
330 cap receiving socket
332 cap receiving socket cylindrical sidewall
334 cap receiving socket bottom wall
339 tear panel hinge
340 cap receiving socket bottom panel flat annular surface
344 cap receiving socket bottom panel "S" shaped score line
346 score line fracture thinned initiation region
360 resealable container cap
365 cap sealing ring
367 flat annular cap bottom sealing surface
369 centered incising projection
370 radially extending cap skirt
372 radially extending cap skirt frangible score lines
381 first embossed cam surface
382 second embossed cam surface
383 third embossed cam surface
390 first socket bottom panel ramp
391 second socket bottom panel ramp
393 second socket bottom panel debossed ramp
394 first cap bottom surface ramp
395 second cap bottom surface ramp
396 third cap bottom surface ramp
400 container
410 resealable container lid
430 cap receiving socket
432 cap receiving socket cylindrical sidewall
434 cap receiving socket bottom wall
436 cap receiving socket bottom panel circular score line
437 score line fracture thinned initiation region
438 cap receiving socket bottom panel tear panel
460 resealable container cap
468 offset projecting incisor
474 resealable container cap grip element
476 resealable container cap grip element first cross member
478 resealable container cap grip element second cross member
479 grip enhancing implement
490 first socket bottom panel ramp
491 second socket bottom panel ramp
492 third socket bottom panel ramp

What is claimed is:

1. A method of using a resealable container lid assembly, the resealable container lid assembly comprising a resealable container lid and a cap, the method comprising steps of:

obtaining a container having the cap rotationally engaging with the resealable container lid;

rotating the cap within the resealable container lid;

controlling a vertical motion of the cap within the container lid by engaging a vertical control feature formed in a sidewall of the cap and a vertical control feature formed in a substantially axially oriented element of the container lid;

engaging a projecting feature extending generally downward from the cap and a debossed feature formed within a bottom panel of the container lid with one another wherein the rotation motion and engagement initiates a fracture between a tear panel and an socket annular surface of the bottom panel of the container lid, wherein the tear panel and the an socket annular surface of the bottom panel are segmented sections of the bottom panel, wherein at least a portion of an edge of the tear panel is designed to fracture and separate from the an socket annular surface of the bottom panel;

continuing rotation of the cap respective to the container lid, wherein the projecting feature engages with an embossed feature formed within the bottom panel of the container lid to propagate the fracture between a tear panel and the an socket annular surface of the bottom panel of the container lid, and rotate the tear panel away from the an socket annular surface of the bottom panel.

2. The method of using the resealable container lid assembly as recited in claim 1, the resealable container lid further comprising a socket formed in the bottom panel of the container lid, wherein the socket includes a socket bottom wall and a socket sidewall, wherein the socket sidewall extends between the socket bottom wall and the container lid bottom panel, wherein the step of controlling a vertical motion of the cap within the container lid by engaging a vertical control feature formed in a sidewall of the cap and a vertical control feature formed in a substantially axially oriented element of the resealable container lid is accomplished having the substantially axially oriented element of the container lid formed in the socket sidewall.

3. The method of using the resealable container lid assembly as recited in claim 2, the container lid further comprising a score line formed in the bottom panel of the container lid, the score line defining a demarcation between the tear panel and the an socket annular surface of the bottom panel of the container lid, wherein the step of fracturing the tear panel and the an socket annular surface of the bottom panel of the container lid from one another is accomplished by fracturing the score line.

4. The method of using the resealable container lid assembly as recited in claim 3, the cap further comprising an incising projection extending downward from the cap, wherein the step of fracturing the tear panel and the an socket annular surface of the bottom panel of the container lid from one another is accomplished by using the incising projection to initiate a fracture of the score line.

5. The method of using the resealable container lid assembly as recited in claim 1, the container lid further comprising a score line formed in the bottom panel of the container lid, the score line defining a demarcation between the tear panel and the an socket annular surface of the bottom panel of the container lid, and the cap further comprising an incising projection extending downward from the cap, wherein the step of fracturing the tear panel and the an socket annular surface of the bottom panel of the container lid from one another is accomplished by using the incising projection to initiate a fracture of the score line.

6. The method of using the resealable container lid assembly as recited in claim 1, the container lid further comprising a score line formed in the bottom panel of the container lid, the score line being shaped to define a tear panel hinge, the score line defining a demarcation between the tear panel and the an socket annular surface of the bottom panel of the container lid, the method further comprising a step of bending the tear panel hinge, rotating the tear panel away from the an socket annular surface of the bottom panel of the container lid.

7. The method of using the resealable container lid assembly as recited in claim 1, the container lid further comprising a score line formed in the lid bottom panel of the container lid, the score line extending between two separate ends thereof, the score line defining a demarcation between the tear panel and the an socket annular surface of the bottom panel of the container lid, the separation between ends one end of the score line and one of the other end of the score line or a point along a length of the score line defining a tear panel hinge, the method further comprising a step of bending the tear panel hinge, rotating the tear panel away from the an socket annular surface of the bottom panel of the container lid.

8. A method of using a resealable container lid assembly, the resealable container lid assembly comprising a resealable container lid and a cap, the method comprising steps of:

obtaining a container having a cap rotationally engaging with a resealable container lid;

rotating the cap within the resealable container lid;

controlling a vertical motion of the cap within the container lid by engaging a vertical control feature formed in a sidewall of the cap and a vertical control feature formed in a substantially axially oriented element of the container lid;

rotating a projecting feature extending generally downward from the cap and a debossed feature formed within a bottom panel of the container lid respective to one another;

continuing rotation of the cap respective to the container lid, wherein the projecting feature engages with an embossed feature formed within the bottom panel of the container lid to propagate a fracture between a tear panel and the an socket annular surface of the bottom panel of the container lid, and rotate the tear panel away from the a socket annular surface of the bottom panel, wherein the tear panel and the an socket annular surface of the bottom panel are segmented sections of the bottom panel, wherein at least a portion of an edge of the tear panel is designed to fracture and separate from the an socket annular surface of the bottom panel.

9. The method of using the resealable container lid assembly as recited in claim 8, the resealable container lid further comprising a socket formed in the bottom panel of the container lid, wherein the socket includes a socket bottom wall and a socket sidewall, wherein the socket sidewall extends between the socket bottom wall and the container lid bottom panel, wherein the step of controlling a vertical motion of the cap within the container lid by engaging a vertical control feature formed in a sidewall of the cap and a vertical control feature formed in a substantially axially oriented element of the resealable container lid is accomplished having the substantially axially oriented element of the container lid formed in the socket sidewall.

10. The method of using the resealable container lid assembly as recited in claim 9, the container lid further comprising a score line formed in the bottom panel of the container lid, the score line defining a demarcation between the tear panel and the an socket annular surface of the bottom panel of the container lid, wherein the step of fracturing the tear panel and the an socket annular surface of the bottom panel of the container lid from one another is accomplished by fracturing the score line.

11. The method of using the resealable container lid assembly as recited in claim 10, wherein the step of fracturing the tear panel and the an socket annular surface of the bottom panel of the container lid from one another is accomplished by using an incising projection to initiate a fracture of the score line.

12. The method of using the resealable container lid assembly as recited in claim 8, the container lid further comprising a score line formed in the bottom panel of the container lid, the score line defining a demarcation between the tear panel and the an socket annular surface of the bottom panel of the container lid, and the cap further comprising an incising projection extending downward from the cap, wherein the step of fracturing the tear panel and the an socket annular surface of the bottom panel of the container lid from one another is accomplished by using the incising projection to initiate a fracture of the score line.

13. The method of using the resealable container lid assembly as recited in claim 8, the container lid further comprising a score line formed in the bottom panel of the container lid, the score line being shaped to define a tear panel hinge, the score line defining a demarcation between the tear panel and the an socket annular surface of the bottom panel of the container lid, the method further comprising a step of bending the tear panel hinge, rotating the tear panel away from the a socket annular surface of the bottom panel of the container lid.

14. The method of using the resealable container lid assembly as recited in claim 8, the container lid further comprising a score line formed in the bottom panel of the container lid, the score line extending between two separate ends thereof, the score line defining a demarcation between the tear panel and the an socket annular surface of the bottom panel of the container lid, the separation between ends one end of the score line and one of the other end of the score line or a point along a length of the score line defining a tear panel hinge, the method further comprising a step of bending the tear panel hinge, rotating the tear panel away from the an socket annular surface of the bottom panel of the container lid.

15. A method of using a resealable container lid assembly, the resealable container lid assembly comprising a resealable container lid and a cap, the method comprising steps of:

obtaining a container having a cap rotationally engaging with a resealable container lid;

rotating the cap within the resealable container lid;

controlling a vertical motion of the cap within the container lid by engaging a vertical control feature formed in a sidewall of the cap and a vertical control feature formed in a substantially axially oriented element of the container lid;

generating a force in an axial direction of the rotation of the cap within the resealable container lid by a combination of:

(a) the engagement between the vertical control feature formed in the sidewall of the cap and (b) the vertical control feature formed in the substantially axially oriented element of the container lid and by engaging a projecting feature of the cap, wherein the projecting feature extends generally downward therefrom:

a debossed feature formed within a bottom panel of the container lid, and an embossed feature formed within the bottom panel of the container lid;

rotating the cap respective to the container lid, wherein the projecting feature of the cap rotates respective to the debossed feature formed within the bottom panel of the container lid;

continuing rotation of the cap respective to the container lid, wherein the projecting feature of the cap engages with the embossed feature formed within the bottom panel of the container lid to propagate a fracture between a tear panel and an an socket annular surface of the bottom panel of the container lid, and rotate the tear panel away from the an socket annular surface of the bottom panel, wherein the tear panel and the an socket annular surface of the bottom panel are segmented sections of the bottom panel, wherein at least a portion of an edge of the tear panel is designed to fracture and separate from the an socket annular surface of the bottom panel.

16. A method of using the resealable container lid assembly as recited in claim 15, wherein the projecting feature of the cap engages with both of:

the debossed feature formed within the bottom panel of the container lid, and the embossed feature formed within the bottom panel of the container lid.

17. A method of using the resealable container lid assembly as recited in claim 15, wherein the engagement between the vertical control feature formed in the sidewall of the cap introduced an additional contribution to the force in an axial direction.

18. A method of using the resealable container lid assembly as recited in claim 17, wherein the projecting feature of the cap engages with both of:

the debossed feature formed within the bottom panel of the container lid, and the embossed feature formed within the bottom panel of the container lid.

19. The method of using the resealable container lid assembly as recited in claim 15, the container lid further comprising a score line formed in the bottom panel of the container lid, the score line defining a demarcation between the tear panel and the an socket annular surface of the bottom panel of the container lid, and the cap further comprising an incising projection extending downward from the cap, wherein the step of fracturing the tear panel and the an socket annular surface of the bottom panel of the container lid from one another is accomplished by using the incising projection to initiate a fracture of the score line.

20. The method of using the resealable container lid assembly as recited in claim 15, the container lid further comprising a score line formed in the bottom panel of the container lid, the score line being shaped to define a tear panel hinge, the score line defining a demarcation between the tear panel and the an socket annular surface of the bottom panel of the container lid, the method further comprising a step of bending the tear panel hinge, rotating the tear panel away from the an socket annular surface of the bottom panel of the container lid.

* * * * *